US012345454B2

(12) United States Patent
Yamaguchi et al.

(10) Patent No.: US 12,345,454 B2
(45) Date of Patent: Jul. 1, 2025

(54) REFRIGERANT CYCLE APPARATUS AND METHOD FOR INSTALLING REFRIGERANT CYCLE APPARATUS

(71) Applicants: DAIKIN INDUSTRIES, LTD., Osaka (JP); DAIKIN EUROPE N.V., Ostend (BE)

(72) Inventors: Takahiro Yamaguchi, Ostend (BE); Takurou Yamada, Osaka (JP)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 389 days.

(21) Appl. No.: 17/898,040

(22) Filed: Aug. 29, 2022

(65) Prior Publication Data

US 2022/0404080 A1 Dec. 22, 2022

Related U.S. Application Data

(63) Continuation of application No. PCT/JP2020/009279, filed on Mar. 4, 2020.

(51) Int. Cl.
*F25B 45/00* (2006.01)
*F25B 41/40* (2021.01)

(52) U.S. Cl.
CPC ..... *F25B 45/00* (2013.01); *F25B 41/40* (2021.01); *F25B 2345/002* (2013.01)

(58) Field of Classification Search
CPC ..... F25B 45/00; F25B 2345/001; F25B 2345/003
See application file for complete search history.

(56) References Cited

U.S. PATENT DOCUMENTS 4,441,330 A * 4/1984 Lower ..... F25B 45/00 62/149
5,231,841 A * 8/1993 McClelland ..... F25B 45/00 62/149
7,597,818 B2 10/2009 Singh et al.
8,883,708 B2 11/2014 Singh et al.
(Continued)

FOREIGN PATENT DOCUMENTS

CN 102052810 A 5/2011
EP 2 317 253 A2 5/2011
(Continued)

OTHER PUBLICATIONS

European Search Report of corresponding EP Application No. 20 923 458.2 dated Oct. 16, 2023.
(Continued)

*Primary Examiner* — Lionel Nouketcha
(74) *Attorney, Agent, or Firm* — GLOBAL IP COUNSELORS, LLP

(57) ABSTRACT

A refrigerant cycle apparatus includes a first heat source unit, a utilization unit, and a connection pipe. An installation method includes a refrigerant recovery step of recovering a first refrigerant having a first GWP and one or both of flammability and toxicity from the first heat source unit, and a refrigerant accommodation step of accommodating, in the first heat source unit, a second refrigerant recovered and regenerated from an existing facility and having a second GWP and one or both of non-flammability and non-toxicity.

13 Claims, 33 Drawing Sheets

(56) References Cited

U.S. PATENT DOCUMENTS

| | | | | |
|---|---|---|---|---|
| 2011/0219794 | A1* | 9/2011 | Shiba | F25B 9/002 29/890.035 |
| 2012/0024008 | A1 | 2/2012 | Okamoto et al. | |
| 2012/0291457 | A1* | 11/2012 | Brown | F25B 45/00 62/77 |

FOREIGN PATENT DOCUMENTS

| | | | |
|---|---|---|---|
| EP | 3 505 842 | A1 | 7/2019 |
| JP | 6-193981 | A | 7/1994 |
| JP | 6-273007 | A | 9/1994 |
| JP | 7-190535 | A | 7/1995 |
| JP | 7-253250 | A | 10/1995 |
| JP | 10-38354 | A | 2/1998 |
| JP | 2000-121134 | A | 4/2000 |
| JP | 2003-194437 | A | 7/2003 |
| JP | 2004-116885 | A | 4/2004 |
| JP | 2004-263948 | A | 9/2004 |
| JP | 2011-94871 | A | 5/2011 |
| JP | 2015-64182 | A | 4/2015 |
| JP | 2017-67383 | A | 4/2017 |
| JP | 2018-532091 | A | 11/2018 |
| WO | 2010/119705 | A1 | 10/2010 |
| WO | 2017/027716 | A1 | 2/2017 |

OTHER PUBLICATIONS

International Preliminary Report of corresponding PCT Application No. PCT/JP2020/009279 dated Sep. 15, 2022.
International Search Report of corresponding PCT Application No. PCT/JP2020/009279 dated Apr. 14, 2020.

* cited by examiner

<S001>

<S301>

<S302>

<S303>

REFRIGERANT CYCLE APPARATUS AND METHOD FOR INSTALLING REFRIGERANT CYCLE APPARATUS

CROSS-REFERENCE TO RELATED APPLICATIONS

This is a continuation of International Application No. PCT/JP2020/009279 filed on Mar. 4, 2020. The entire disclosures of this application is incorporated by reference herein.

BACKGROUND

Technical Field

The present disclosure relates to a refrigerant cycle apparatus and an installation method for the refrigerant cycle apparatus.

Background Art

EP 3505842 A1 discloses an installation method for a refrigerant cycle apparatus. In this installation method, first, a refrigerant having non-flammability and a high global warming potential (GWP) is removed from a refrigerant cycle apparatus having been already installed. Next, a refrigerant having flammability and a low GWP is put into the refrigerant cycle apparatus.

SUMMARY

An installation method according to one aspect is for a refrigerant cycle apparatus. The refrigerant cycle apparatus includes a first heat source unit, a utilization unit, and a connection pipe. The method includes a refrigerant recovery step and a refrigerant accommodation step. In the refrigerant recovery step, a first refrigerant is recovered from the first heat source unit. The first refrigerant has a first GWP and at least one of flammability or toxicity. In the refrigerant accommodation step, a second refrigerant is accommodated in the first heat source unit. The second refrigerant is recovered and regenerated from an existing facility, has a second GWP, and has at least one of non-flammability or non-toxicity.

In this method, the second refrigerant can be used in the refrigerant cycle apparatus configured using a new first heat source unit. Therefore, the refrigerant cycle apparatus of a new model can be installed in an environment that does not permit use of the first refrigerant having flammability or toxicity.

A refrigerant cycle apparatus according to another aspect includes the first heat source unit, the utilization unit, and the connection pipe. The first heat source unit accommodates the second refrigerant after the first refrigerant accommodated in the first heat source unit is taken out. The first refrigerant has the first GWP and at least one of flammability or toxicity. The second refrigerant has the second GWP and at least one of non-flammability or non-toxicity. The second refrigerant is recovered and regenerated from the existing facility. The connection pipe connects the first heat source unit and the utilization unit.

In this configuration, the refrigerant cycle apparatus uses the second refrigerant. Therefore, the refrigerant cycle apparatus using the first heat source unit of a new model can be used in an environment that does not permit use of the first refrigerant.

DETAILED DESCRIPTION OF EMBODIMENT(S)

Basic Configuration (I) Refrigerant

In the present disclosure, two types of refrigerants, a first refrigerant R1 and a second refrigerant R2, are used.

The first refrigerant R1 has a first GWP and at least one of flammability or toxicity. As used herein, the term "flammability" includes Class A2L ("low flammability"), Class A2 ("flammability"), and Class A3 ("high flammability") in the safety classification designated in ISO 817. Furthermore, as used herein, "toxicity" includes Class B2L, Class B2, and Class B3 in the safety classification designated in ISO 817.

The second refrigerant R2 has a second GWP and at least one of non-flammability or non-toxicity. The second GWP is larger than the first GWP. The second refrigerant R2 may be, for example, a mixed refrigerant including a component identical to a component of the first refrigerant R1.

The first refrigerant R1 is, for example, R32. The second refrigerant R2 is, for example, R410A.

(2) Refrigerant Cycle Apparatus 100 to be Installed

Figure 1:
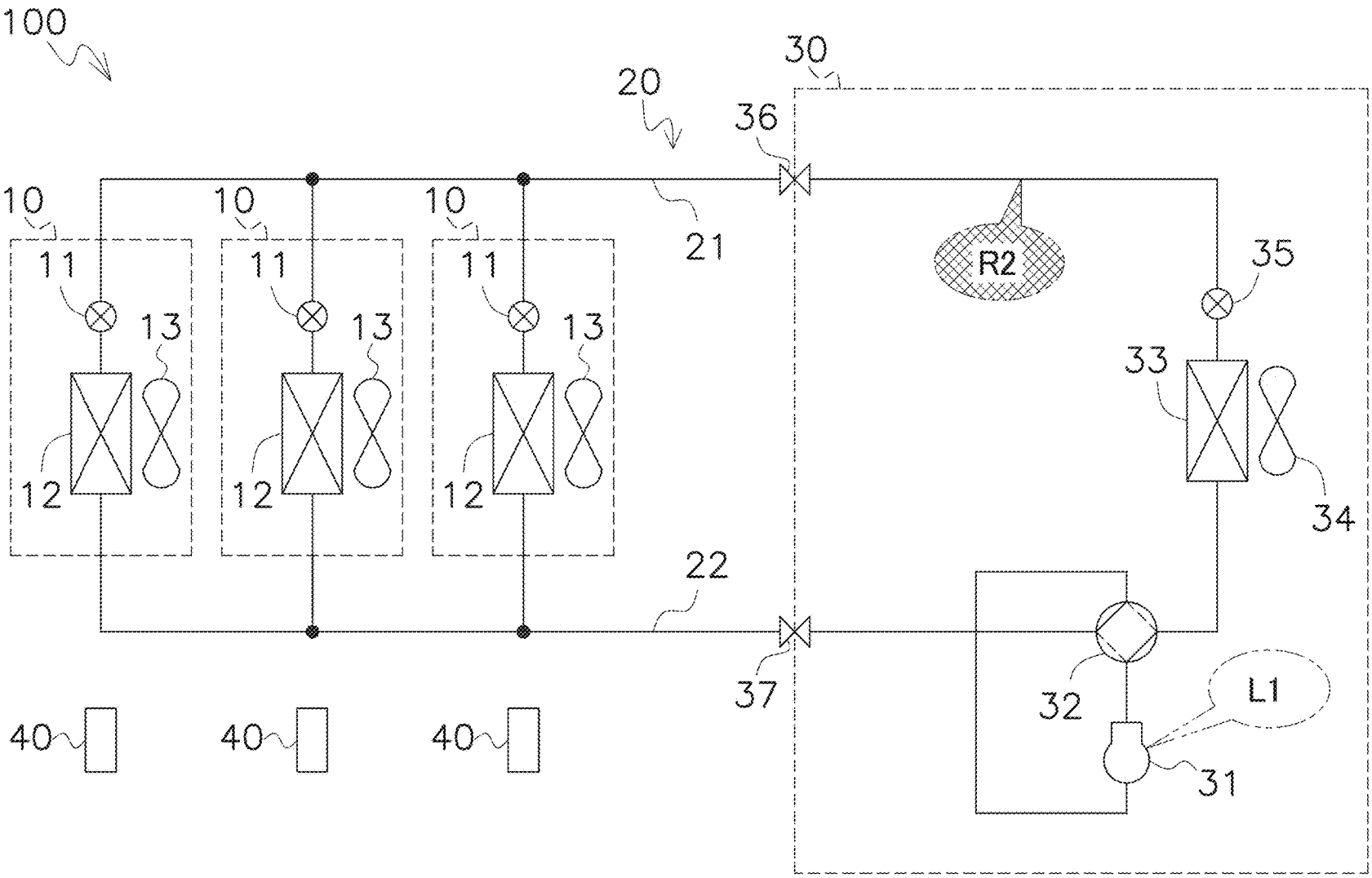
FIG. 1 is a circuit diagram of a refrigerant cycle apparatus 100 installed by an installation method of the present disclosure.

FIG. 1 illustrates a configuration of a refrigerant cycle apparatus 100 installed by an installation method of the present disclosure. The refrigerant cycle apparatus 100 provides cold or heat to a user by circulating the second refrigerant R2. The refrigerant cycle apparatus 100 may be configured as any product including, for example, an air conditioner, a refrigerator, a freezer, a water heater, or a floor heater. In the present disclosure, the refrigerant cycle apparatus 100 will be described as an air conditioner.

The refrigerant cycle apparatus 100 includes a utilization unit 10, a connection piping 20, a first heat source unit 30, and a remote controller 40.

(2-1) Utilization Unit 10

The refrigerant cycle apparatus 100 includes one or a plurality of utilization units 10. The utilization unit 10 is installed in a room used by the user. One utilization unit 10 includes a utilization expansion valve 11, a utilization heat exchanger 12, and a utilization fan 13.

(2-1-1) Utilization Expansion Valve 11

The utilization expansion valve 11 controls a flow rate of the second refrigerant R2. The utilization expansion valve 11 functions as a decompressor for the second refrigerant R2, and thus, for example, can change the second refrigerant R2 in a liquid state into the second refrigerant R2 in a gas-liquid two-phase state.

(2-1-2) Utilization Heat Exchanger 12

The utilization heat exchanger 12 exchanges heat between the second refrigerant R2 and air. When the refrigerant cycle apparatus 100 performs a cooling operation, the utilization heat exchanger 12 functions as an evaporator or a heat absorber for the second refrigerant R2. When the refrigerant cycle apparatus 100 performs a heating operation, the utilization heat exchanger 12 functions as a condenser or a heat radiator for the second refrigerant R2.

(2-1-3) Utilization Fan 13

The utilization fan 13 generates an air flow passing through the utilization heat exchanger 12 to promote heat exchange at the utilization heat exchanger 12.

(2-2) Connection Piping 20

The connection piping 20 connects the utilization unit 10 and the first heat source unit 30. The connection piping 20 includes a liquid refrigerant pipe 21 and a gas refrigerant pipe 22. The liquid refrigerant pipe 21 principally guides, for example, the second refrigerant R2 in a liquid state or in a gas-liquid two-phase state. The gas refrigerant pipe 22 principally guides, for example, the second refrigerant R2 in a gas state.

(2-3) First Heat Source Unit 30

The first heat source unit 30 is installed outside the room used by the user, typically outdoors. The first heat source unit 30 includes a compressor 31, a four-way switching valve 32, a heat source heat exchanger 33, a heat source fan 34, a heat source expansion valve 35, a liquid refrigerant port 36, a gas refrigerant port 37, and first lubricating oil L1.

(2-3-1) Compressor 31

The compressor 31 sucks the second refrigerant R2 in a low-pressure gas state and discharges the second refrigerant R2 in a high-pressure gas state.

(2-3-2) Four-Way Switching Valve 32

The four-way switching valve 32 changes connection of pipes. During cooling operation, the four-way switching valve 32 achieves connection depicted by solid lines in FIG. 1. During heating operation, the four-way switching valve 32 achieves connection depicted by broken lines in FIG. 1.

(2-3-3) Heat Source Heat Exchanger 33

The heat source heat exchanger 33 exchanges heat between the second refrigerant R2 and air. When the refrigerant cycle apparatus 100 performs a cooling operation, the heat source heat exchanger 33 functions as a condenser or a heat radiator for the second refrigerant R2. When the refrigerant cycle apparatus 100 performs the heating operation, the heat source heat exchanger 33 functions as an evaporator or a heat absorber for the second refrigerant R2.

(2-3-4) Heat Source Fan 34

The heat source fan 34 generates an air flow passing through the heat source heat exchanger 33 to promote heat exchange at the heat source heat exchanger 33.

(2-3-5) Heat Source Expansion Valve 35

The heat source expansion valve 35 controls a flow rate of the second refrigerant R2. The heat source expansion valve 35 functions as a decompressor for the second refrigerant R2, and thus, for example, can change the second refrigerant R2 in a liquid state into the second refrigerant R2 in a gas-liquid two-phase state.

The refrigerant cycle apparatus 100 may include only one of the utilization expansion valve 11 or the heat source expansion valve 35.

(2-3-6) Liquid Refrigerant Port 36

The liquid refrigerant port 36 is an openable and closable valve. The liquid refrigerant port 36 is connected to the liquid refrigerant pipe 21. The liquid refrigerant port 36 is opened when the refrigerant cycle apparatus 100 is used. The liquid refrigerant port 36 is closed when the first heat source unit 30 is installed, for example.

(2-3-7) Gas Refrigerant Port 37

The gas refrigerant port 37 is an openable and closable valve. The gas refrigerant port 37 is connected to the gas refrigerant pipe 22. The gas refrigerant port 37 is opened when the refrigerant cycle apparatus 100 is used. The gas refrigerant port 37 is closed when the first heat source unit 30 is installed, for example.

(2-3-8) First Lubricating Oil L1

The first heat source unit 30 accommodates the first lubricating oil L1 for lubricating a sliding portion of the compressor 31.

(2-4) Remote Controller 40

The remote controller 40 is provided so as to correspond to each utilization unit 10. The remote controller 40 enables the user to provide an instruction to the refrigerant cycle apparatus 100. The remote controller 40 can communicate with the utilization unit 10.

(3) Existing Refrigerant Cycle Apparatus 200

Figure 2:
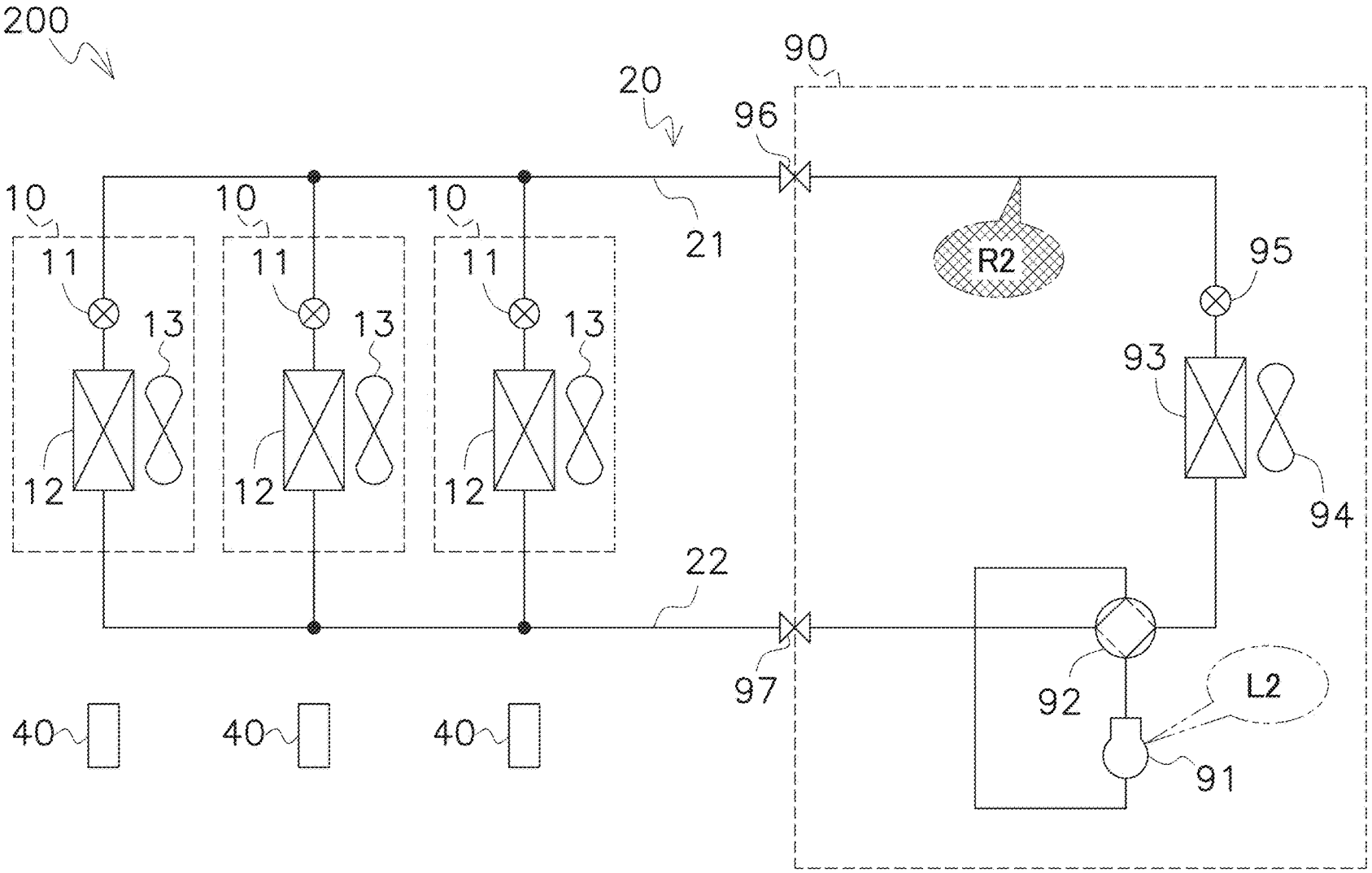
FIG. 2 illustrates an example of an existing refrigerant cycle apparatus 200.

FIG. 2 illustrates an example of an existing refrigerant cycle apparatus 200 that has been operated before the refrigerant cycle apparatus 100 is installed. The existing refrigerant cycle apparatus 200 is an existing facility.

The existing refrigerant cycle apparatus 200 includes the utilization unit 10, the connection piping 20, and a second heat source unit 90. The existing refrigerant cycle apparatus 200 uses the second refrigerant R2.

The utilization unit 10 of the existing refrigerant cycle apparatus 200 is the same as the utilization unit 10 included in the refrigerant cycle apparatus 100.

The connection piping 20 of the existing refrigerant cycle apparatus 200 is the same as the connection piping 20 included in the refrigerant cycle apparatus 100.

The second heat source unit 90 of the existing refrigerant cycle apparatus 200 is different from the first heat source unit 30 included in the refrigerant cycle apparatus 100. The second heat source unit 90 includes a compressor 91, the four-way switching valve 32, a heat source heat exchanger 93, a heat source fan 94, a heat source expansion valve 95, a liquid refrigerant port %, and a gas refrigerant port 97. These constituent parts have functions similar to functions of constituent parts of the first heat source unit 30. The second heat source unit 90 is assumed to be a product of an older model than the first heat source unit 30.

The second heat source unit 90 accommodates second lubricating oil L2 for lubricating a sliding portion of the compressor 91.

(4) Installation Method for Existing Refrigerant Cycle Apparatus 200

The existing refrigerant cycle apparatus 200 is installed by the following method.

(4-1) First Step (Step S001)

Figure 3:
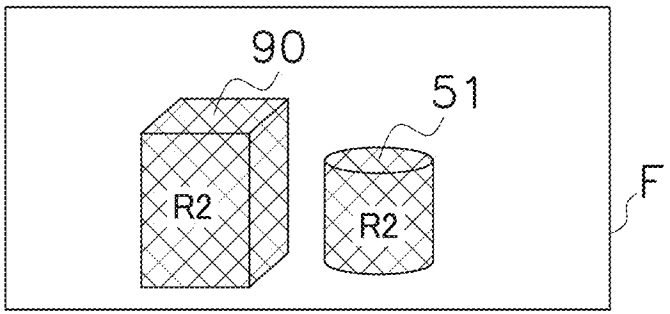
FIG. 3 illustrates a first step (step S001) of an installation method for the existing refrigerant cycle apparatus 200.
Figure 3:
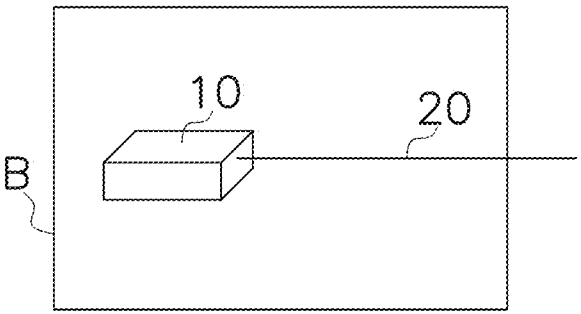

As illustrated in FIG. 3, the second heat source unit 90 waiting for shipment in a factory F already accommodates a predetermined amount of the second refrigerant R2. This is because, if a refrigerant circuit of the second heat source unit 90 is evacuated or filled with air, the second heat source unit 90 could be damaged by transportation.

In the factory F, a refrigerant storage container 51 that accommodates the second refrigerant R2 for additional filling is prepared. In the present description, it is assumed that the number of refrigerant storage containers 51 is one. Alternatively, the number of refrigerant storage containers 51 may be two or more.

One or a plurality of utilization units 10 and the connection piping 20 are installed in a building B.

(4-2) Second Step (Step S002)

Figure 4:
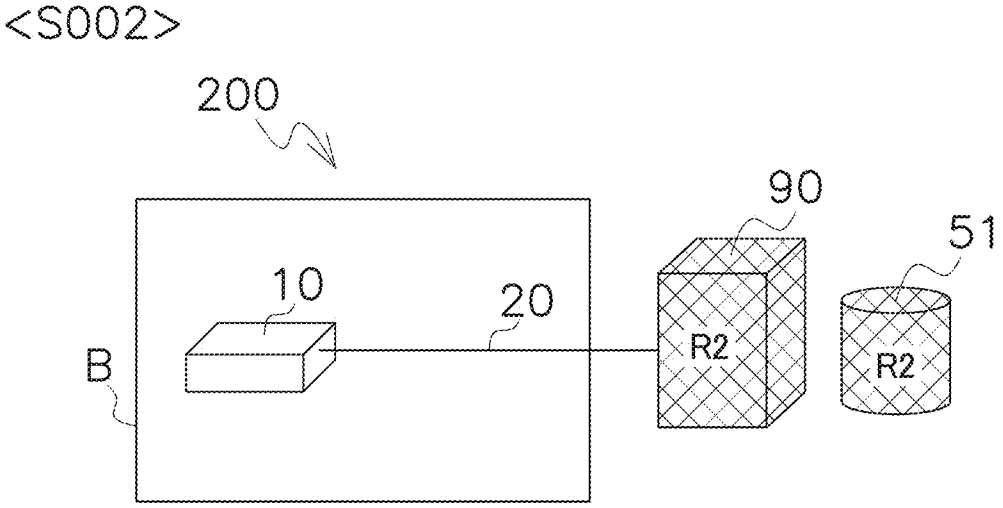
FIG. 4 illustrates a second step (step S002) of the installation method for the existing refrigerant cycle apparatus 200.

As illustrated in FIG. 4, the second heat source unit 90 and the refrigerant storage container 51 are transported to the building B. The connection piping 20 is connected to the liquid refrigerant port 96 and the gas refrigerant port 97 of the second heat source unit 90. Accordingly, the existing refrigerant cycle apparatus 200 is configured.

(4-3) Third Step (Step S003)

Figure 5:
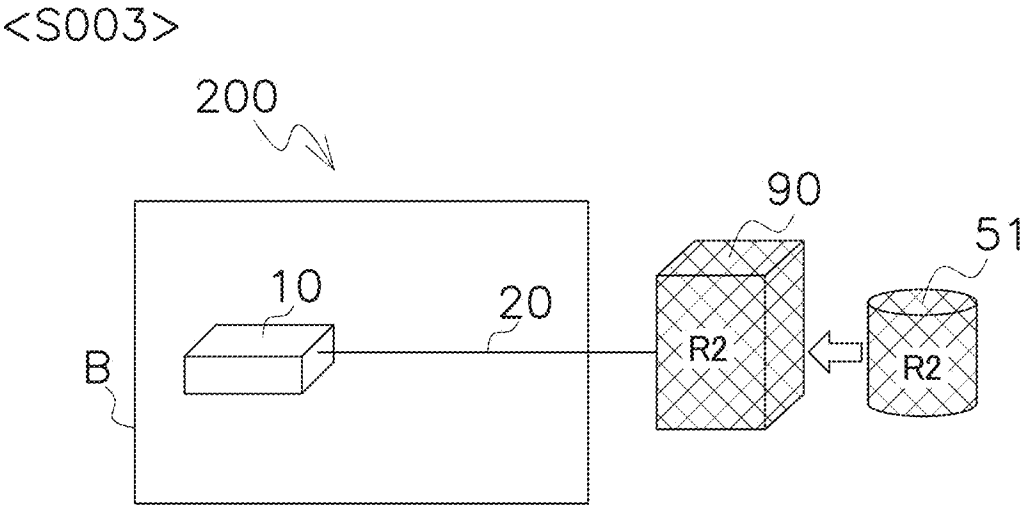
FIG. 5 illustrates a third step (step S003) of the installation method for the existing refrigerant cycle apparatus 200.

As illustrated in FIG. 5, the second heat source unit 90 is additionally filled with the second refrigerant R2 accommodated in the refrigerant storage container 51.

(4-4) Fourth Step (Step S004)

Figure 6:
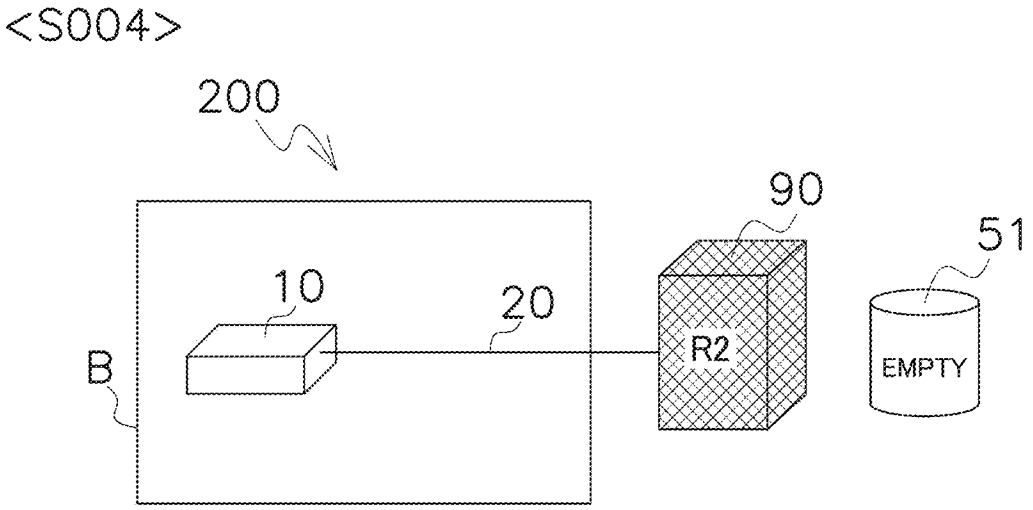
FIG. 6 illustrates a fourth step (step S004) of the installation method for the existing refrigerant cycle apparatus 200.

As illustrated in FIG. 6, the existing refrigerant cycle apparatus 200 receives the second refrigerant R2 in an amount required by the existing refrigerant cycle apparatus 200 as a whole. Accordingly, the existing refrigerant cycle apparatus 200 can be used.

First Embodiment

Non-flammable refrigerants currently on the market, such as the second refrigerant R2, are being replaced by refrigerants having a small GWP but having flammability or toxicity (hereinafter, referred to as a "flammable refrigerant or the like"), such as the first refrigerant R1, for the purpose of suppressing global warming. It is therefore expected that a refrigerant cycle apparatus using a flammable refrigerant or the like, such as the above-mentioned refrigerant cycle apparatus 100 to be installed, will become dominant among refrigerant cycle apparatuses manufactured in factories in the future. On the other hand, in some buildings, the use of a flammable refrigerant or the like may be deemed undesirable from the view-point of safety. In this way, there is still a need for both a non-flammable refrigerant and a flammable refrigerant or the like in the market.

In order to respond to all refrigerant needs, it is conceivable to adopt the following installation procedure. First, a refrigerant circuit of a refrigerant cycle apparatus to be shipped from a factory is evacuated or filled with air. Next, the refrigerant cycle apparatus is transported to an installation site. Finally, the installed refrigerant cycle apparatus is filled with a desired refrigerant.

However, the refrigerant cycle apparatus not accommodating a refrigerant could be damaged by transportation.

Therefore, there are some need for an installation method that enables the user to employ a flammable refrigerant or the like.

An installation method according to a first embodiment will be described. In this installation method, the second heat source unit 90 included in the existing refrigerant cycle apparatus 200 is replaced with the first heat source unit 30 to be newly shipped. Specifically, the refrigerant cycle apparatus 100 is installed by the following method.

(1) Procedure of Installation Method (1-1) First Step (Step S101)

Figure 7:
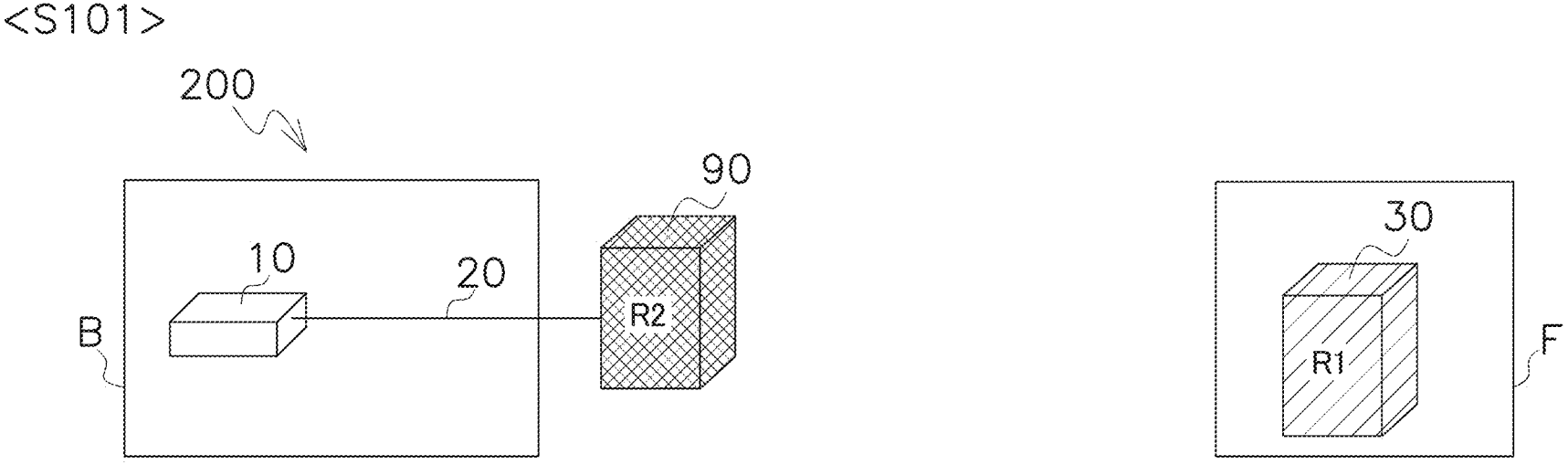
FIG. 7 illustrates a first step (step S10*l*) of an installation method according to a first embodiment.

As illustrated in FIG. 7, the existing refrigerant cycle apparatus 200 using the second refrigerant R2 is installed in the building B. The first heat source unit 30 accommodates a predetermined amount of the first refrigerant R1 waiting for shipment in the factory F.

(1-2) Second Step (Step S102)

Figure 8:
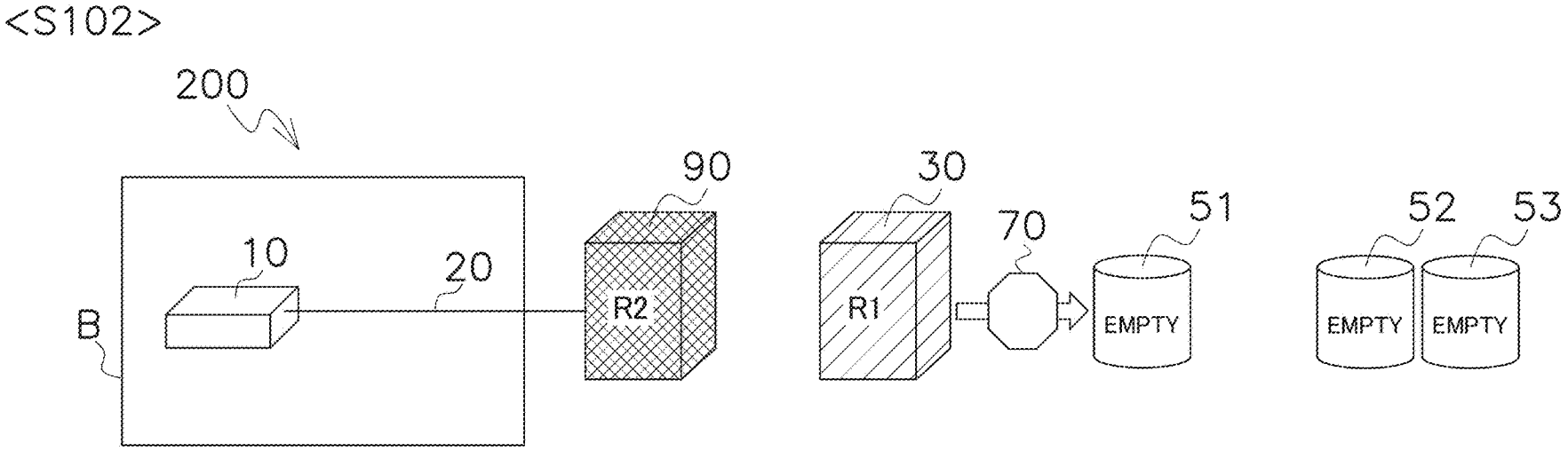
FIG. 8 illustrates a second step (step S102) of the installation method according to the first embodiment.

As illustrated in FIG. 8, the first heat source unit 30 is transported to the building B. A first refrigerant storage container 51, a second refrigerant storage container 52, and a third refrigerant storage container 53 that are empty are prepared near the building B. In the present description, it is assumed that the number of the first refrigerant storage containers 51, the number of the second refrigerant storage containers 52, and the number of the third refrigerant storage containers 53 are all one. Alternatively, the numbers may be two or more.

Next, the first refrigerant R1 is recovered from the first heat source unit 30. At this time, the first refrigerant R1 in a gas state may be recovered from the first heat source unit 30 through the gas refrigerant port 37. During the recovery of the first refrigerant R1, the first lubricating oil L1 accommodated in the first heat source unit 30 may be left in the first heat source unit 30. By recovering the first refrigerant R1 in a gas state, the first lubricating oil L1 in a liquid state can remain in the first heat source unit 30.

The recovered first refrigerant R1 is regenerated by a refrigerant regenerator 70. In this regeneration processing, the refrigerant regenerator 70 may remove water included in the first refrigerant R1 from the first refrigerant R1.

The regenerated first refrigerant R1 is transferred from the refrigerant regenerator 70 to the first refrigerant storage container 51.

(1-3) Third Step (Step S103)

Figure 9:
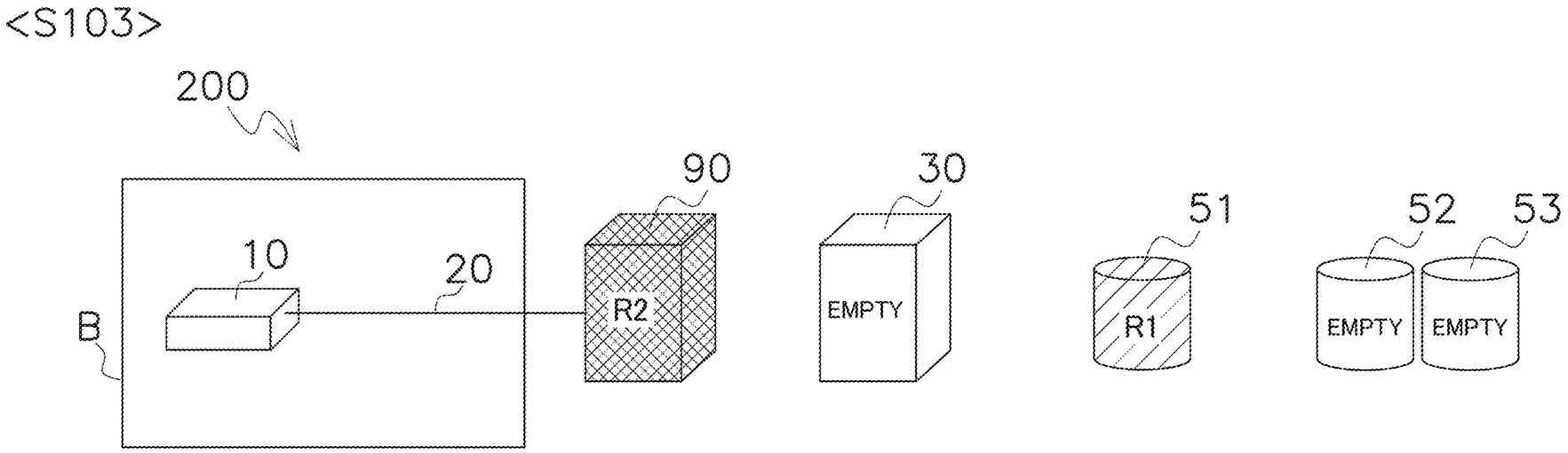
FIG. 9 illustrates a third step (step S103) of the installation method according to the first embodiment.

As illustrated in FIG. 9, the first refrigerant storage container 51 finishes accommodating the first refrigerant R1. In the first heat source unit 30, almost no first refrigerant R1 is present.

(1-4) Fourth Step (Step S104)

Figure 10:
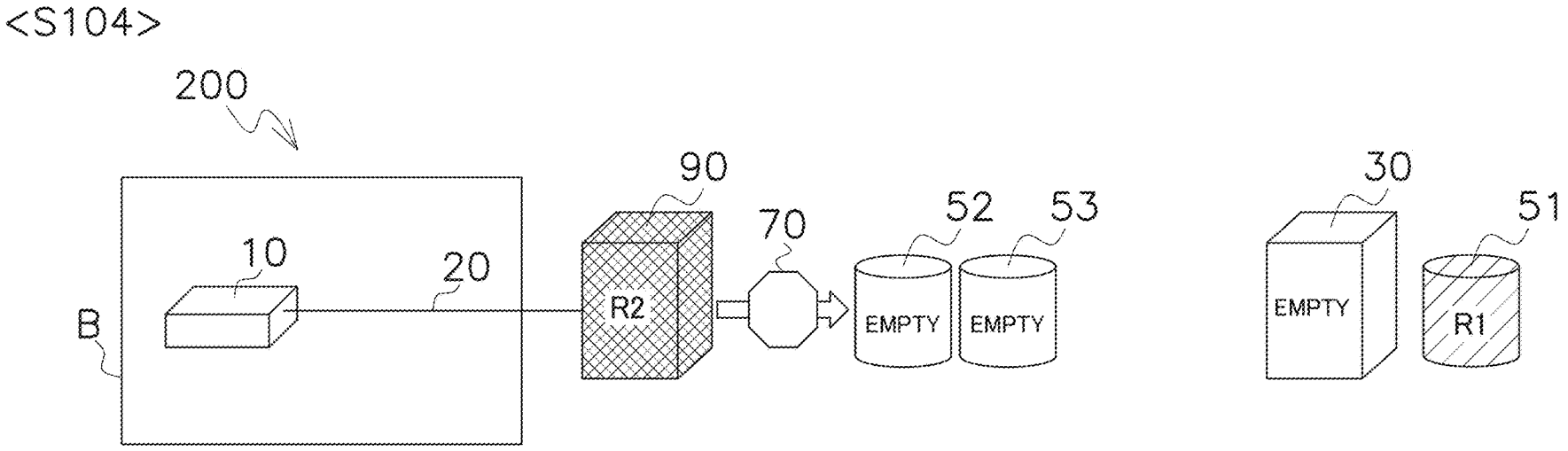
FIG. 10 illustrates a fourth step (step S104) of the installation method according to the first embodiment.

As illustrated in FIG. 10, the second refrigerant R2 is recovered from the second heat source unit 90 of the existing refrigerant cycle apparatus 200. At this time, the second refrigerant R2 is regenerated by the refrigerant regenerator 70. In this regeneration processing, the refrigerant regenerator 70 removes at least one of the second lubricating oil L2 or water included in the second refrigerant R2 from the second refrigerant R2. Preferably, the refrigerant regenerator 70 removes the second lubricating oil L2 from the second refrigerant R2. The refrigerant regenerator 70 may remove both the second lubricating oil L2 and water from the second refrigerant R2.

The regenerated second refrigerant R2 is transferred from the refrigerant regenerator 70 to the second refrigerant storage container 52 and the third refrigerant storage container 53.

(1-5) Fifth Step (Step S105)

Figure 11:
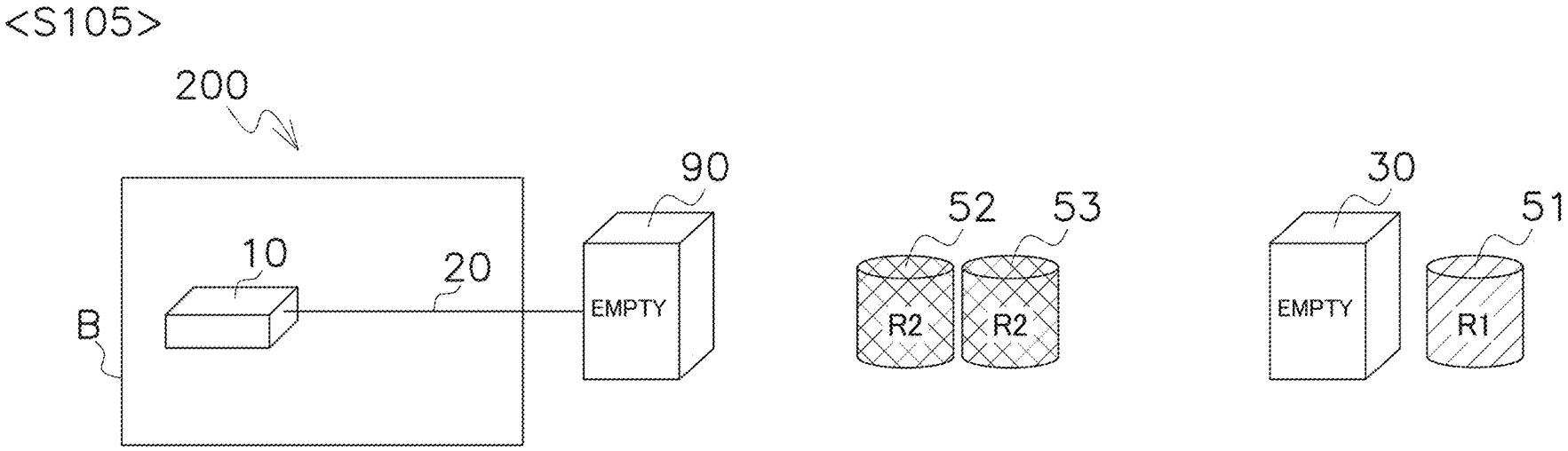
FIG. 11 illustrates a fifth step (step S105) of the installation method according to the first embodiment.

As illustrated in FIG. 11, the second refrigerant storage container 52 and the third refrigerant storage container 53 finish accommodating the second refrigerant R2. In the second heat source unit 90, almost no second refrigerant R2 is present.

(1-6) Sixth Step (Step S106)

Figure 12:
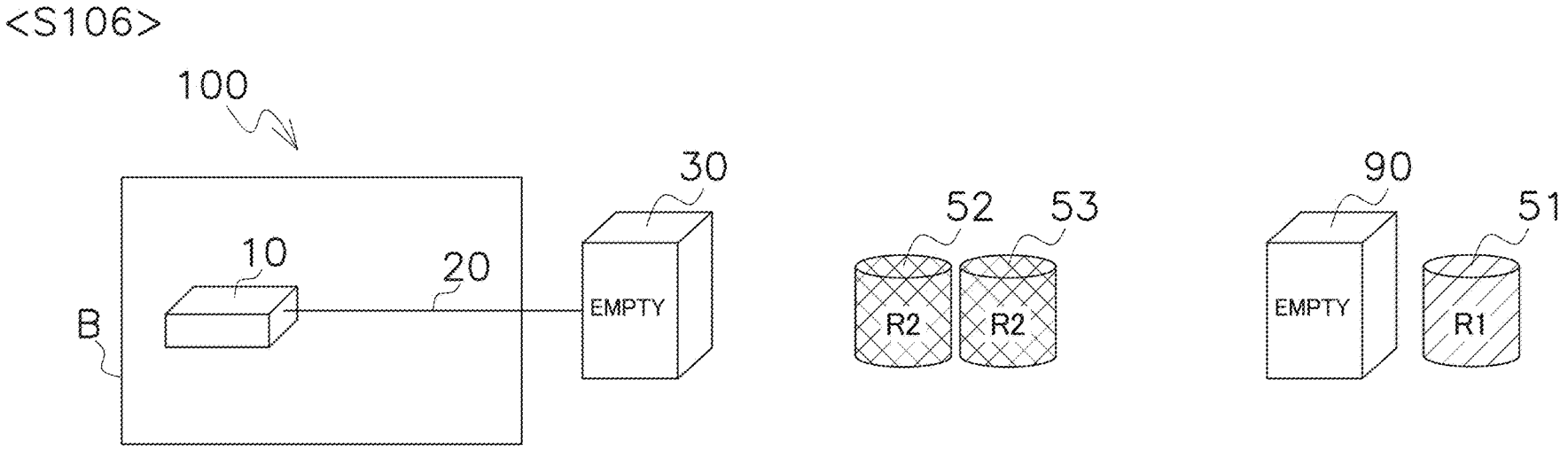
FIG. 12 illustrates a sixth step (step S106) of the installation method according to the first embodiment.

As illustrated in FIG. 12, the second heat source unit 90 is disconnected from the connection piping 20 of the existing refrigerant cycle apparatus 200. This disconnection may be performed by closing the liquid refrigerant port 96 and the gas refrigerant port 97 configured by openable and closable valves, which does not necessarily involve removal of the second heat source unit 90.

Next, the first heat source unit 30 is connected to the connection piping 20. Accordingly, the refrigerant cycle apparatus 100 is configured.

(1-7) Seventh Step (Step S107)

Figure 13:
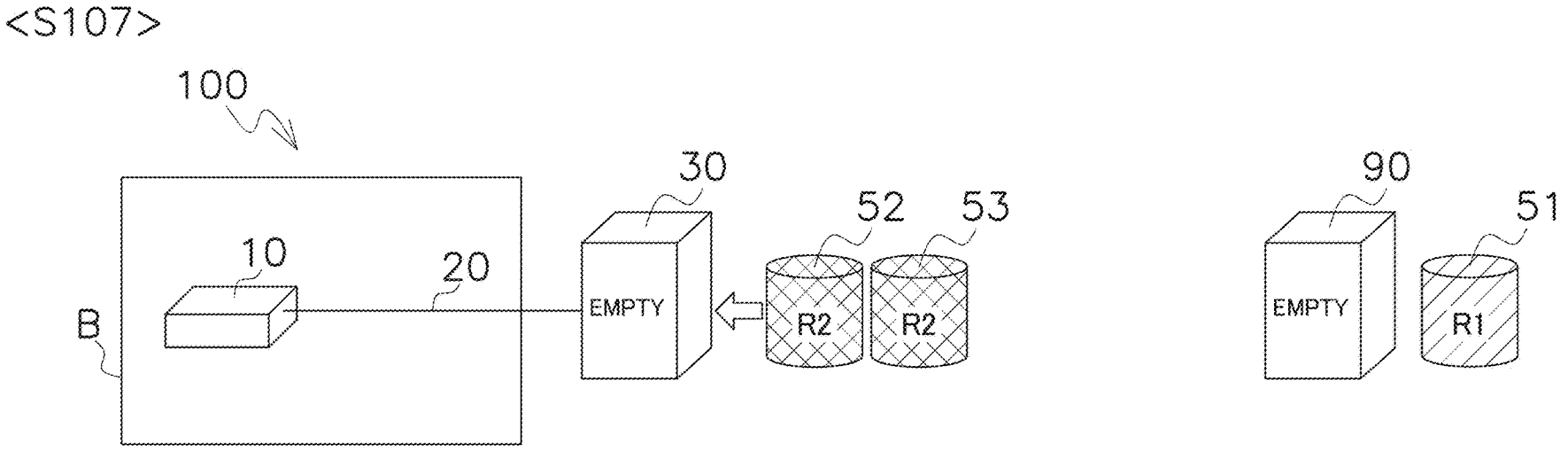
FIG. 13 illustrates a seventh step (step S107) of the installation method according to the first embodiment.

As illustrated in FIG. 13, the regenerated second refrigerant R2 accommodated in the second refrigerant storage container 52 and the third refrigerant storage container 53 is accommodated in the first heat source unit 30.

(1-8) Eighth Step (Step S108)

Figure 14:
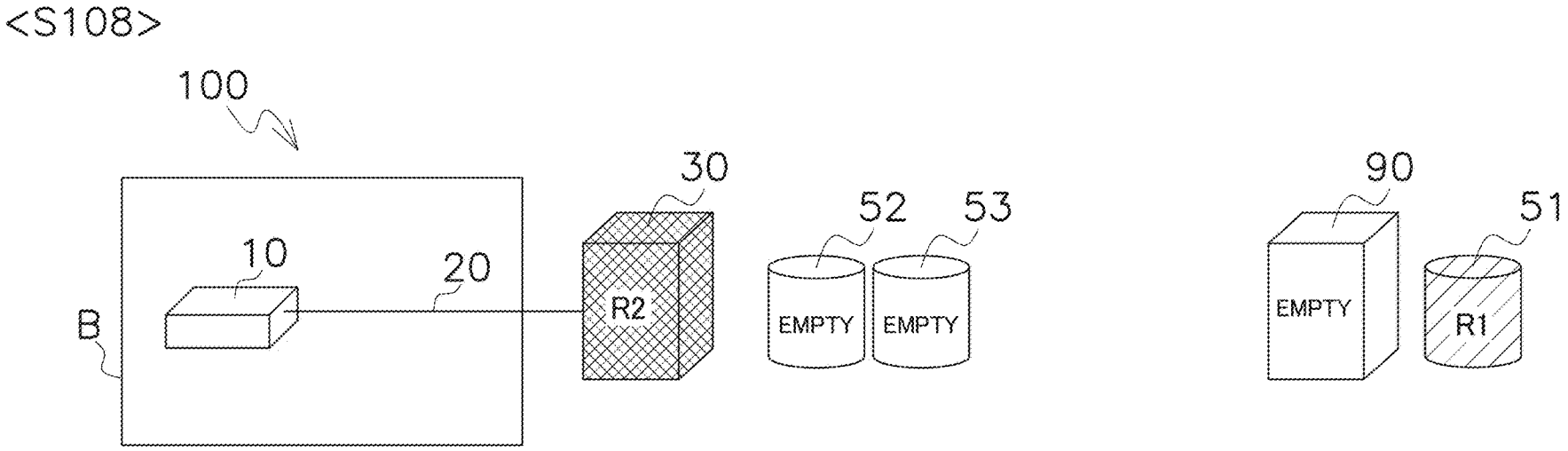
FIG. 14 illustrates an eighth step (step S108) of the installation method according to the first embodiment.

As illustrated in FIG. 14, the refrigerant cycle apparatus 100 receives the second refrigerant R2 in an amount required by the refrigerant cycle apparatus 100 as a whole. Accordingly, the refrigerant cycle apparatus 100 can be used.

(1-9) Ninth Step (Step S109)

Figure 15:
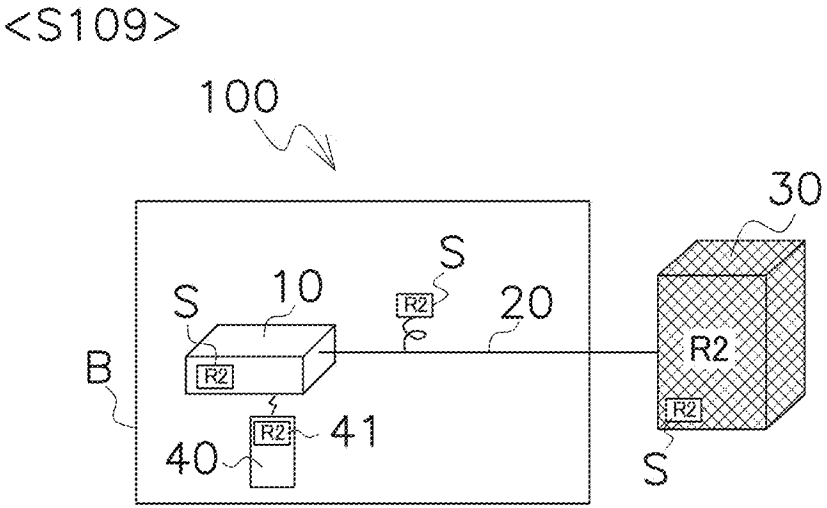
FIG. 15 illustrates a ninth step (step S109) of the installation method according to the first embodiment.

As illustrated in FIG. 15, a display S indicating that the second refrigerant R2 is used is attached to at least a part of the utilization unit 10, the connection piping 20, and the first heat source unit 30. The remote controller 40 may include a display unit 41 that electrically displays that the second refrigerant R2 is used.

The display unit 41 may display not only the name of the second refrigerant R2 but also at least part of the properties (for example, flammability or non-flammability, toxicity or non-toxicity, specific gravity, or the like) of the second refrigerant R2, the fact that the second refrigerant R2 accommodated in the refrigerant cycle unit 100 has been once recovered from any refrigerant circuit, and the fact that the second refrigerant R2 accommodated in the refrigerant cycle unit 100 has been regenerated. The display unit 41 may display the above information not only as characters but also in a form such as a bar code or a QR code (registered trademark).

(2) Setting of Type of Refrigerant

An optimum operation of the refrigerant cycle apparatus 100 (for example, an opening degree of the expansion valve and a number of rotations of the compressor) varies depending on a type of refrigerant used. Thus, a control unit of the refrigerant cycle apparatus 100 needs to know the type of refrigerant to be used.

The refrigerant cycle apparatus 100 may include a refrigerant setting switch for the purpose of notifying the control unit of the type of refrigerant. In this case, an installation operator can manually switch the refrigerant setting switch to notify the control unit of the type of refrigerant. The control unit can change the operation of the refrigeration cycle apparatus 100 in accordance with the type of refrigerant designated by the refrigerant setting switch.

Alternatively, the control unit of the refrigerant cycle apparatus 100 may automatically recognize the type of refrigerant. For example, the control unit can recognize the type of refrigerant used by knowing a balance point of a refrigerant cycle.

(3) Characteristics (3-1)

In the installation method according to the present embodiment, the second refrigerant R2 can be used in the refrigerant cycle apparatus 100 configured using a new first heat source unit 30. Therefore, the refrigerant cycle apparatus 100 of a new model can be installed in an environment that does not permit use of the first refrigerant R1 having flammability or toxicity.

(3-2)

In the installation method according to the present embodiment, the refrigerant cycle apparatus 100 of a new model can be configured using a part of the existing refrigerant cycle apparatus 200. Therefore, costs of the refrigerant cycle apparatus 100 can be reduced.

(3-3)

In the installation method according to the present embodiment, the second refrigerant R2 is accommodated in the second refrigerant storage container 52 and the third refrigerant storage container 53. It is therefore easy to know the amount of the recovered second refrigerant R2 by the number of refrigerant storage containers used.

(3-4)

In the installation method according to the present embodiment, at least one of the second lubricating oil L2 or water is removed from the second refrigerant R2. Therefore, the recovered second refrigerant R2 can be reused in an apparatus that does not permit mixing of the second lubricating oil L2 or water.

(3-5)

In the installation method according to the present embodiment, the first lubricating oil L1 may be left in the first heat source unit 30. Therefore, when the second refrigerant R2 permits the use of the first lubricating oil L1, an installation cost can be reduced.

(3-6)

In the installation method according to the present embodiment, the first refrigerant R1 may be recovered in a gas state from the first heat source unit 30. It is therefore possible to suppress a situation in which the first lubricating oil L1 accommodated in the first heat source unit 30 is taken out from the first heat source unit 30 together with the first refrigerant R1.

(3-7)

In the installation method according to the present embodiment, the first refrigerant R1 recovered from the first heat source unit 30 is regenerated. Therefore, the first refrigerant R1 can be reused.

(3-8)

The installation method according to the present embodiment enables a maintenance worker of the refrigerant cycle apparatus 100 to easily understand that the second refrigerant R2 is used in the refrigerant cycle apparatus 100 by viewing the display S or the display unit 41. It is therefore possible to suppress a situation in which the refrigerant cycle apparatus 100 is used in an incorrect manner.

(3-9)

In the installation method according to the present embodiment, the second refrigerant R2 may include a component identical to the component of the first refrigerant R1. Thus, the first refrigerant R1 recovered in the step of recovering the first refrigerant R1 can be reused in the refrigerant cycle apparatus 100.

For example, a case where the first refrigerant R1 is R32 and the second refrigerant R2 is R410A is considered. R410 is a mixture of R32 and R125. Thus, the first refrigerant R1 (or R32) recovered and regenerated from the existing refrigerant cycle apparatus 200 can be used as a raw material of the regenerated second refrigerant R2 (or R410A) used in the refrigerant cycle apparatus 100.

By regenerating the recovered first refrigerant R1 in this manner, the regenerated first refrigerant R1 can be used in a different apparatus.

(3-10)

In the installation method according to the present embodiment, by regenerating the second refrigerant R2 recovered from the existing refrigerant cycle apparatus 200, a production amount of the second refrigerant R2 having a large second GWP can be reduced as compared with a case where the installation method according to the present embodiment is not used. Therefore, global warming can be suppressed.

(3-11)

The refrigerant cycle apparatus 100 according to the present embodiment uses the second refrigerant R2. Therefore, the refrigerant cycle apparatus 100 using the first heat source unit 30 of a new model can be used in an environment that does not permit use of the first refrigerant R1.

(3-12)

The maintenance worker of the refrigerant cycle apparatus 100 can easily obtain information on the refrigerant used in the refrigerant cycle apparatus 100 according to the present embodiment by viewing the display S or the display unit 41. It is therefore possible to suppress a situation in which the refrigerant cycle apparatus 100 is used in an incorrect manner.

Second Embodiment

An installation method according to a second embodiment will be described. This installation method is different from the installation method according to the first embodiment in that the first heat source unit 30 is used as a refrigerant storage container for accommodating the second refrigerant R2.

In the installation method according to the second embodiment, the second heat source unit 90 included in the existing refrigerant cycle apparatus 200 is replaced with the first heat source unit 30 to be newly shipped, as in the first embodiment.

(1) Procedure of Installation Method (1-1) First Step (Step S201)

Figure 16:
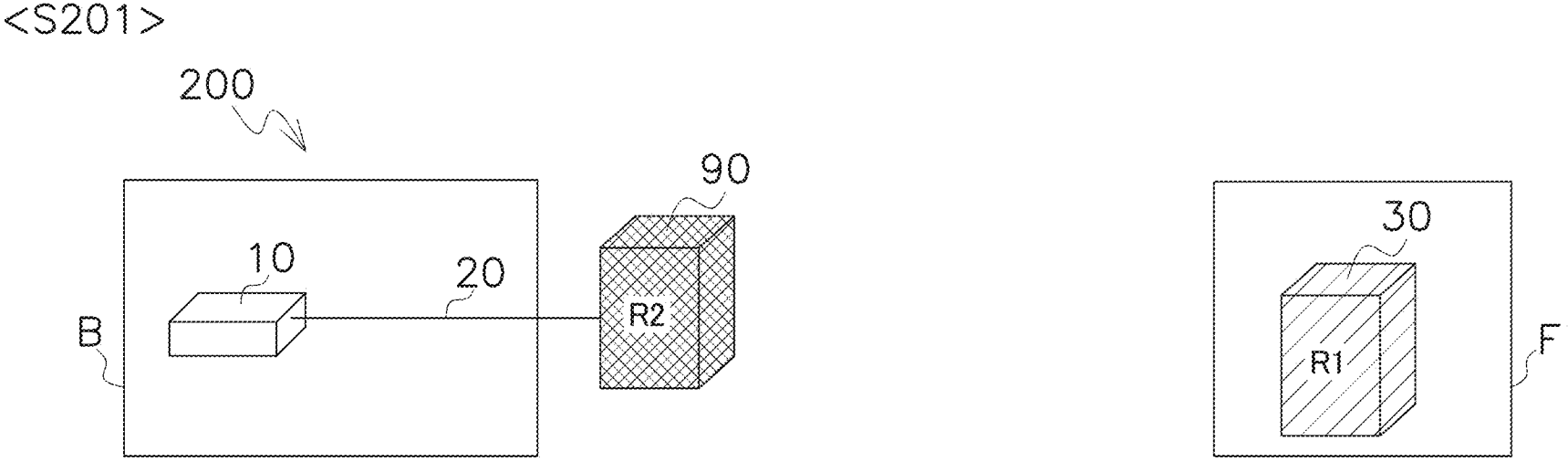
FIG. 16 illustrates a first step (step S201) of an installation method according to a second embodiment.

As illustrated in FIG. 16, the existing refrigerant cycle apparatus 200 using the second refrigerant R2 is installed in the building B. The first heat source unit 30 accommodates a predetermined amount of the first refrigerant R1 waiting for shipment in the factory F.

(1-2) Second step (step S202)

Figure 17:
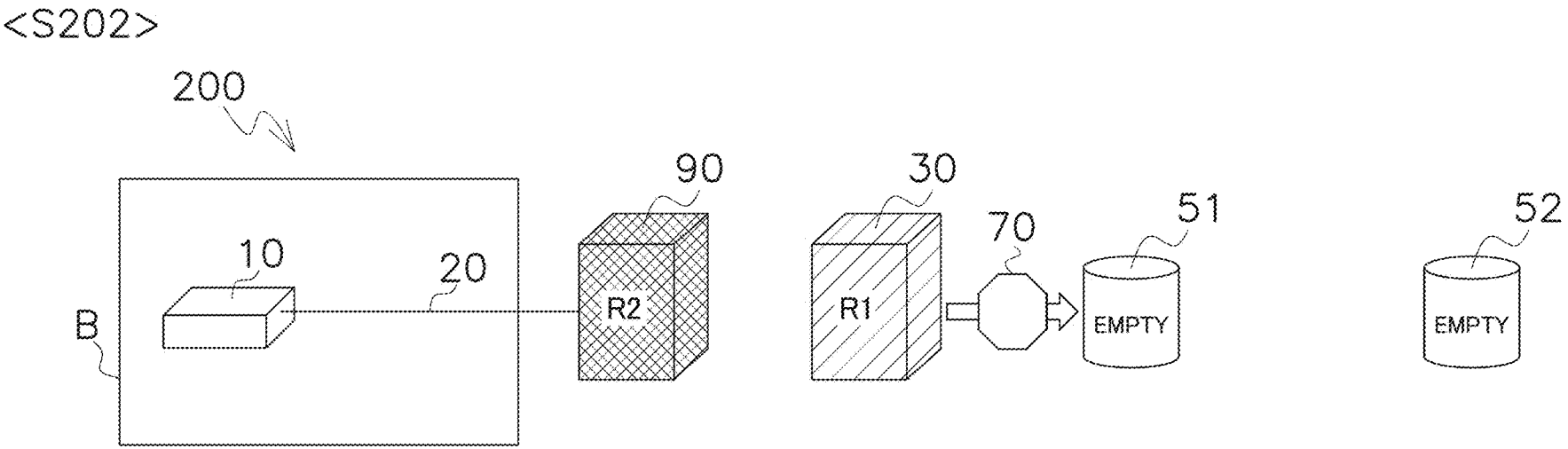
FIG. 17 illustrates a second step (step S202) of the installation method according to the second embodiment.

As illustrated in FIG. 17, the first heat source unit 30 is transported to the building B. The first refrigerant storage container 51 and the second refrigerant storage container 52 that are empty are prepared near the building B. In the present description, it is assumed that the number of the first refrigerant storage containers 51 and the number of the second refrigerant storage containers 52 are both one. Alternatively, the numbers may be two or more.

Next, the first refrigerant R1 is recovered from the first heat source unit 30. At this time, the first refrigerant R1 in a gas state may be recovered from the first heat source unit 30 through the gas refrigerant port 37. During the recovery of the first refrigerant R1, the first lubricating oil L1 accommodated in the first heat source unit 30 may be left in the first heat source unit 30. By recovering the first refrigerant R1 in a gas state, the first lubricating oil L1 in a liquid state can remain in the first heat source unit 30.

The recovered first refrigerant R1 is regenerated by a refrigerant regenerator 70. In this regeneration processing, the refrigerant regenerator 70 may remove water included in the first refrigerant R1 from the first refrigerant R1.

The regenerated first refrigerant R1 is transferred from the refrigerant regenerator 70 to the first refrigerant storage container 51.

(1-3) Third Step (Step S203)

Figure 18:
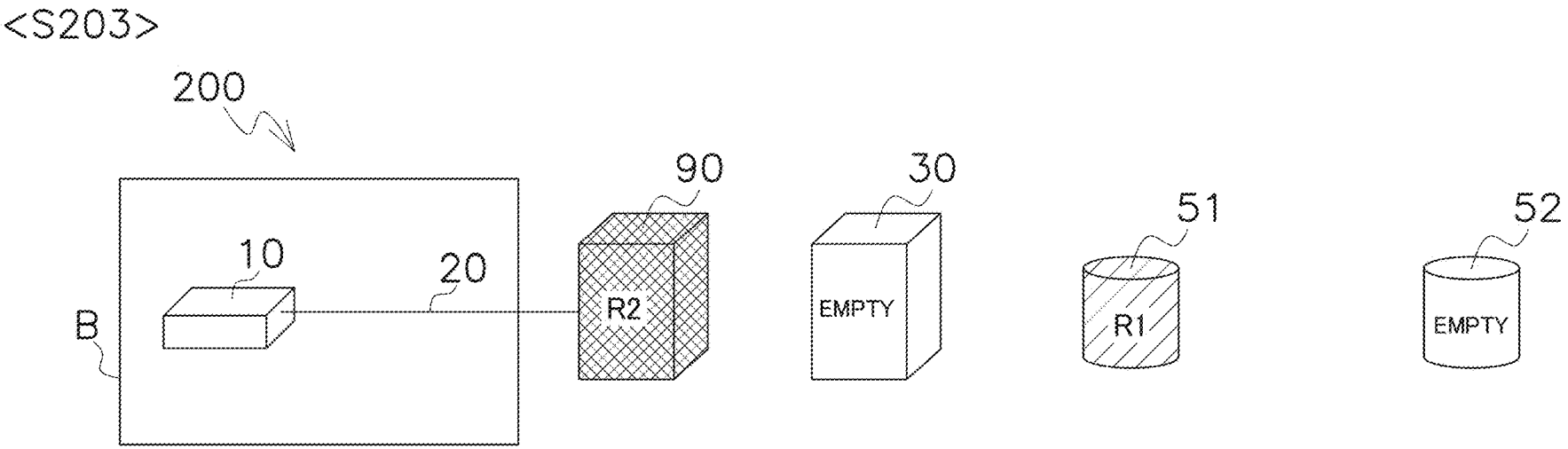
FIG. 18 illustrates a third step (step S203) of the installation method according to the second embodiment.

As illustrated in FIG. 18, the first refrigerant storage container 51 finishes accommodating the first refrigerant R1. In the first heat source unit 30, almost no first refrigerant R1 is present.

(1-4) Fourth Step (Step S204)

Figure 19:
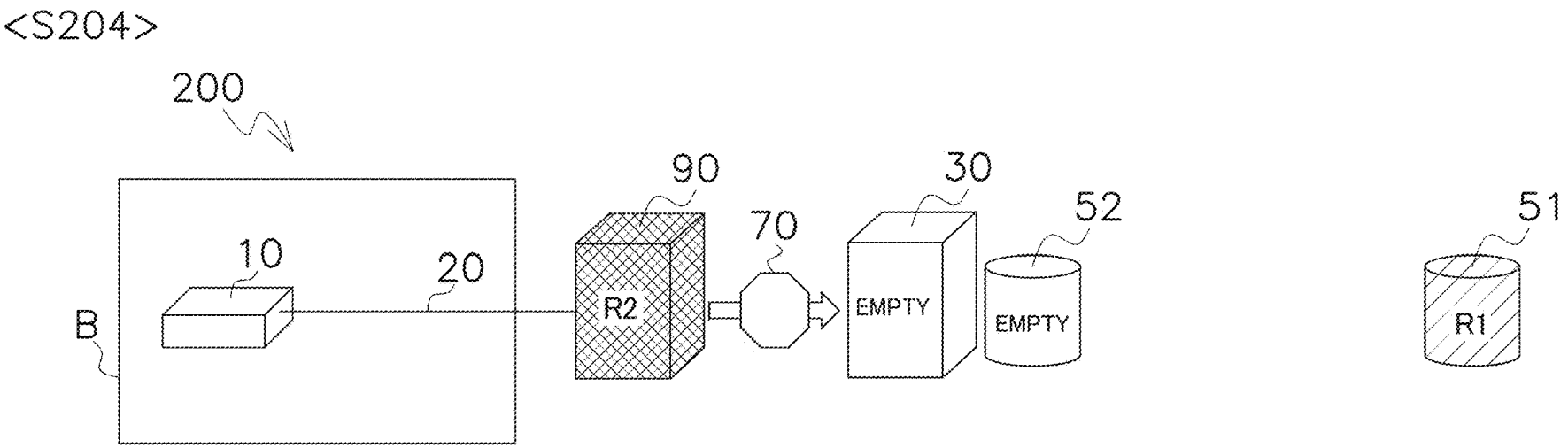
FIG. 19 illustrates a fourth step (step S204) of the installation method according to the second embodiment.

As illustrated in FIG. 19, the second refrigerant R2 is recovered from the second heat source unit 90 of the existing refrigerant cycle apparatus 200. At this time, the second refrigerant R2 is regenerated by the refrigerant regenerator 70. In this regeneration processing, the refrigerant regenerator 70 removes at least one of the second lubricating oil L2 or water included in the second refrigerant R2 from the second refrigerant R2. Preferably, the refrigerant regenerator 70 removes the second lubricating oil L2 from the second refrigerant R2. The refrigerant regenerator 70 may remove both the second lubricating oil L2 and water from the second refrigerant R2.

The regenerated second refrigerant R2 is transferred from the refrigerant regenerator 70 to the first heat source unit 30 and the second refrigerant storage container 52.

(1-5) Fifth Step (Step S205)

Figure 20:
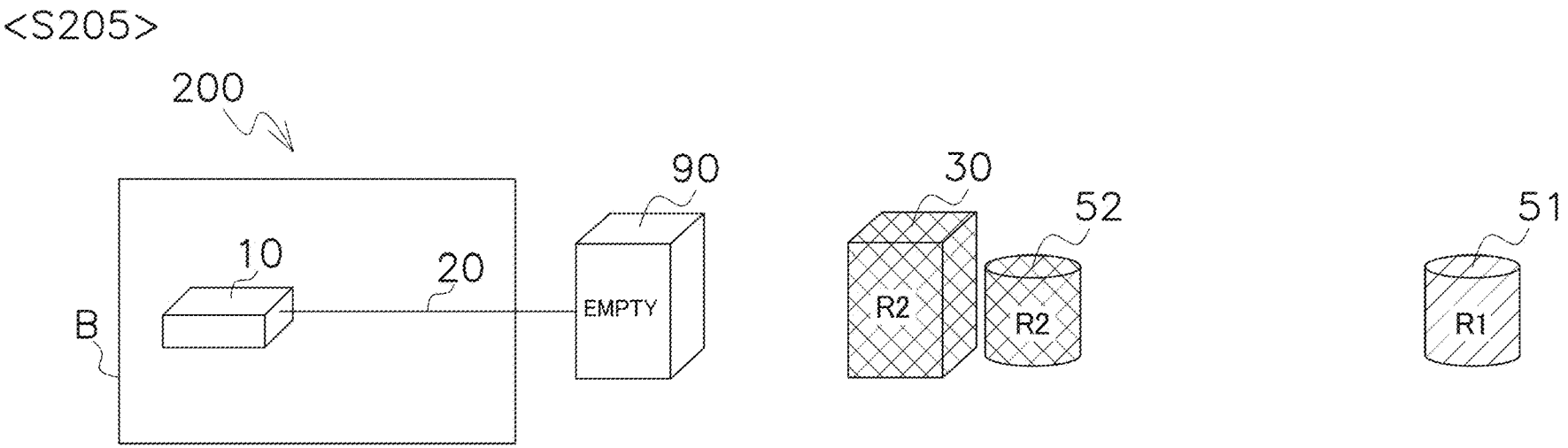
FIG. 20 illustrates a fifth step (step S205) of the installation method according to the second embodiment.

As illustrated in FIG. 20, the first heat source unit 30 and the second refrigerant storage container 52 finish accommodating the second refrigerant R2. In the second heat source unit 90, almost no second refrigerant R2 is present.

(1-6) Sixth Step (Step S206)

Figure 21:
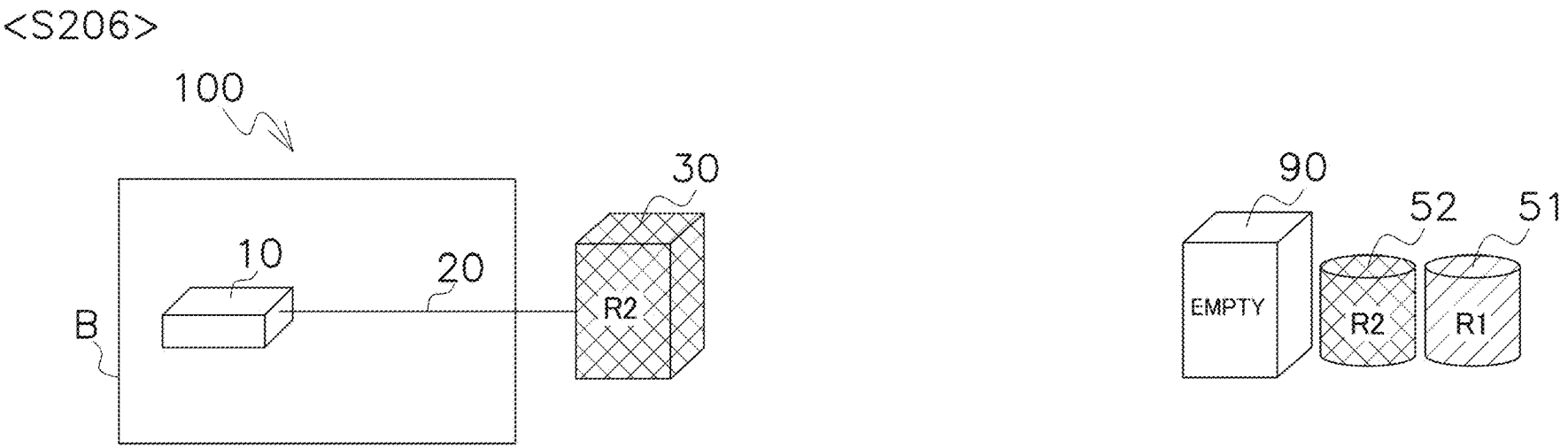
FIG. 21 illustrates a sixth step (step S206) of the installation method according to the second embodiment.

As illustrated in FIG. 21, the second heat source unit 90 is disconnected from the connection piping 20 of the existing refrigerant cycle apparatus 200. Next, the first heat source unit 30 is connected to the connection piping 20. Accordingly, the refrigerant cycle apparatus 100 is configured.

(1-7) Seventh Step (Step S207)

Figure 22:
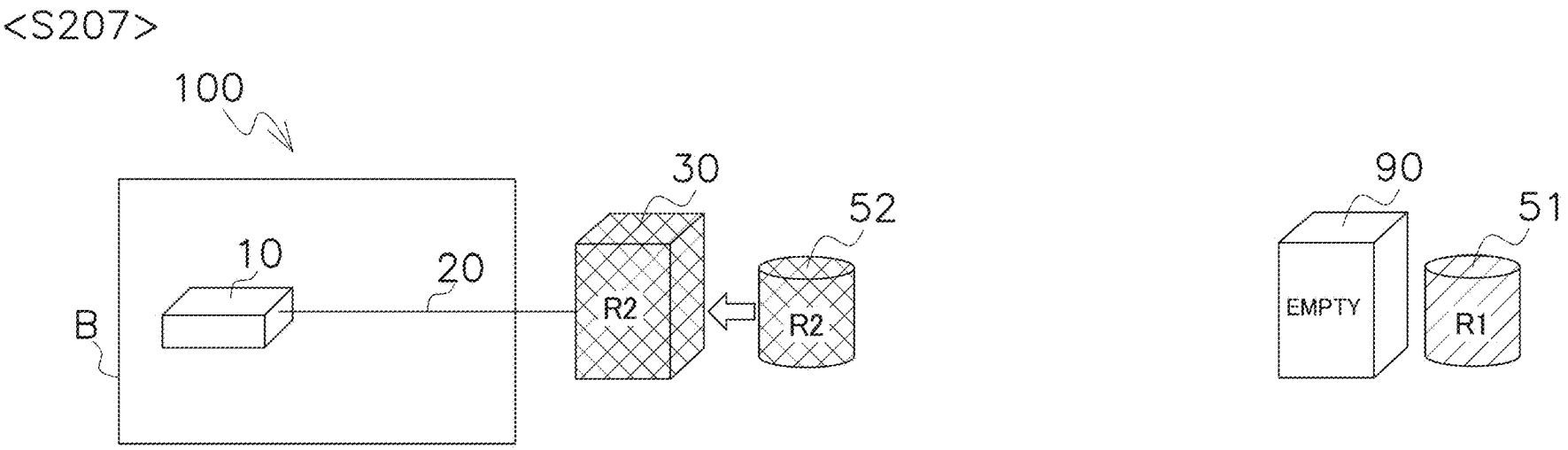
FIG. 22 illustrates a seventh step (step S207) of the installation method according to the second embodiment.

As illustrated in FIG. 22, the regenerated second refrigerant R2 included in the second refrigerant storage container 52 is additionally accommodated in the first heat source unit 30.

(1-8) Eighth Step (Step S208)

Figure 23:
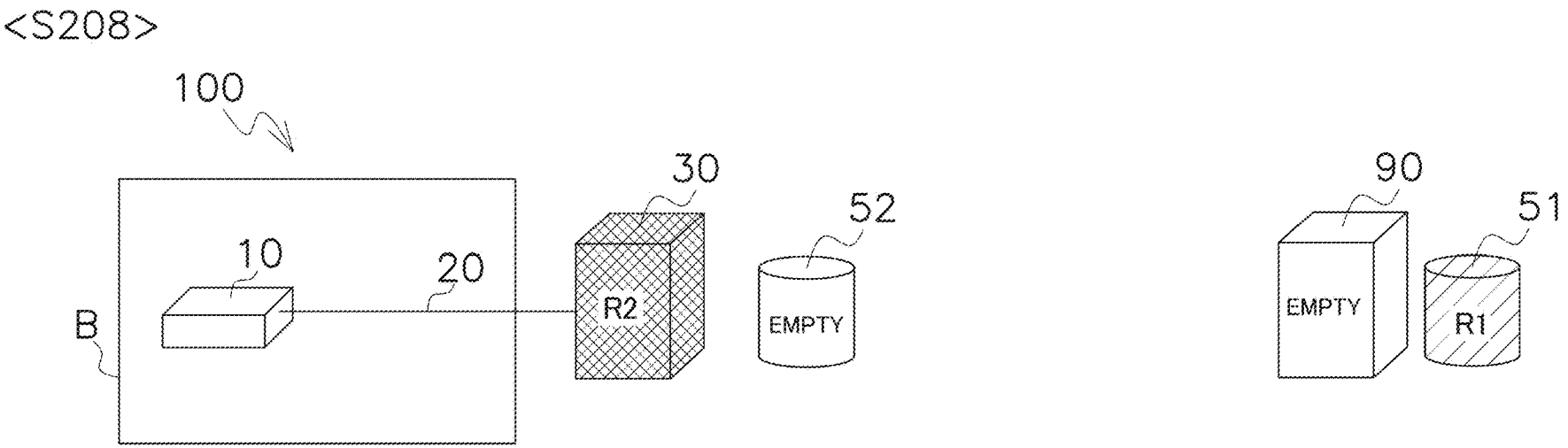
FIG. 23 illustrates an eighth step (step S208) of the installation method according to the second embodiment.

As illustrated in FIG. 23, the refrigerant cycle apparatus 100 receives the second refrigerant R2 in an amount required by the refrigerant cycle apparatus 100 as a whole. Accordingly the refrigerant cycle apparatus 100 can be used.

(1-9) Ninth Step (Step S209)

Figure 24:
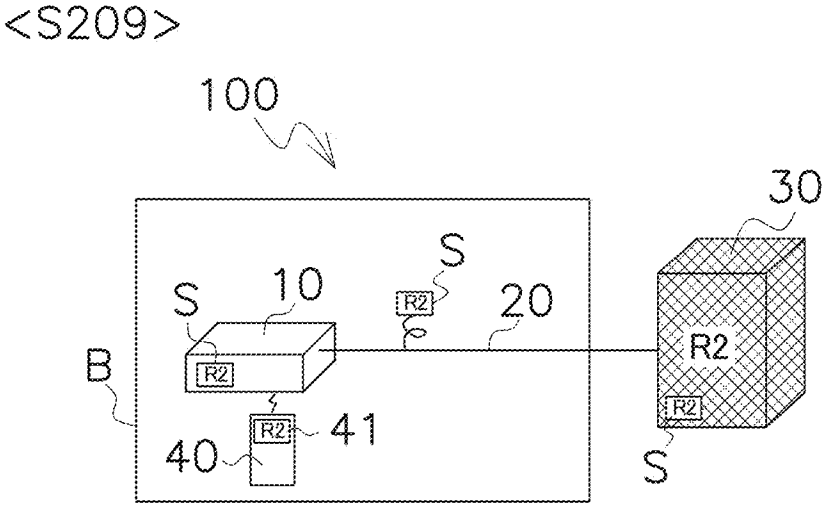
FIG. 24 illustrates a ninth step (step S209) of the installation method according to the second embodiment.

As illustrated in FIG. 24, the display S indicating that the second refrigerant R2 is used is attached to at least a part of the utilization unit 10, the connection piping 20, or the first heat source unit 30. The remote controller 40 may include a display unit 41 that electrically displays that the second refrigerant R2 is used. The content and form of the information displayed on the display unit 41 are similar to those in the first embodiment.

(2) Setting of Type of Refrigerant

The setting of the type of refrigerant in the second embodiment is similar to that in the first embodiment.

(3) Characteristics

In the installation method according to the present embodiment, the first heat source unit 30 is used as a storage container for the second refrigerant R2. Therefore, since the number of refrigerant storage containers required for installing the refrigerant cycle apparatus 100 can be reduced, the installation cost can be reduced.

Third Embodiment

An installation method according to a third embodiment will be described. In this installation method, unlike the first embodiment and the second embodiment, the second refrigerant R2 recovered from a separate-system refrigerant cycle apparatus 300 that does not share constituent parts with the refrigerant cycle apparatus 100 is used in the refrigerant cycle apparatus 100. The separate-system refrigerant cycle apparatus 300 of a different system is an existing facility. The refrigerant cycle apparatus 100 is installed by the following method.

(1) Procedure of Installation Method (1-1) First Step (Step S301)

Figure 25:
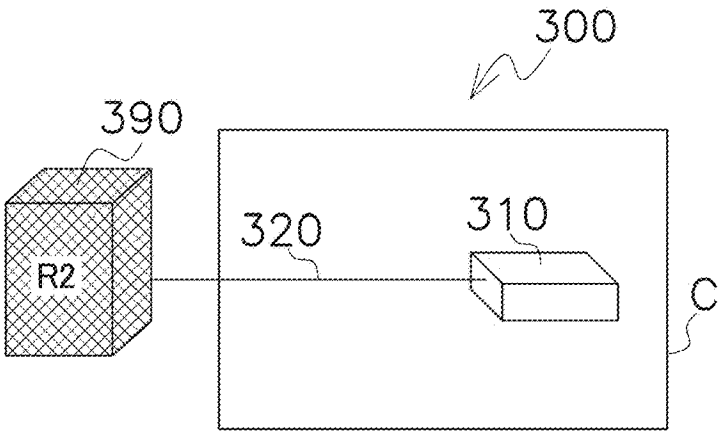
FIG. 25 illustrates a first step (step S301) of an installation method according to a third embodiment.

As illustrated in FIG. 25, the separate-system refrigerant cycle apparatus 300 using the second refrigerant R2 is installed in a building C. The separate-system refrigerant cycle apparatus 300 includes a utilization unit 310, a connection pipe 320, and a third heat source unit 390.

(1-2) Second Step (Step S302)

Figure 26:
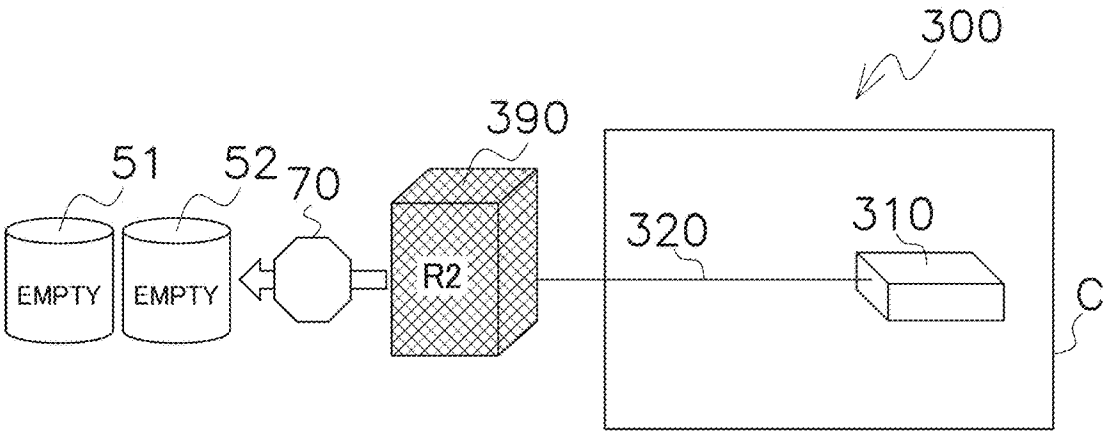
FIG. 26 illustrates a second step (step S302) of the installation method according to the third embodiment.

As illustrated in FIG. 26, the first refrigerant storage container 51 and the second refrigerant storage container 52 that are empty are prepared near the building C. In the present description, it is assumed that the number of the first refrigerant storage containers 51 and the number of the second refrigerant storage containers 52 are both one. Alternatively, the numbers may be two or more.

Next, the second refrigerant R2 is recovered from the third heat source unit 390. The recovered second refrigerant R2 is regenerated by the refrigerant regenerator 70. The regenerated second refrigerant R2 is transferred from the refrigerant regenerator 70 to the first refrigerant storage container 51 and the second refrigerant storage container 52.

(1-3) Third Step (Step S303)

Figure 27:
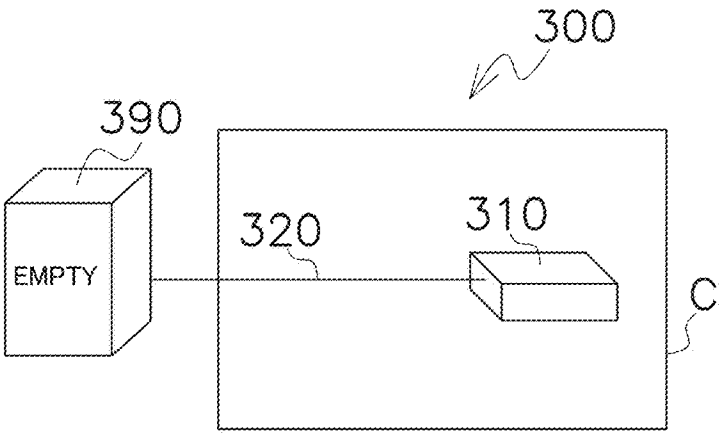
FIG. 27 illustrates a third step (step S303) of the installation method according to the third embodiment.
Figure 27:
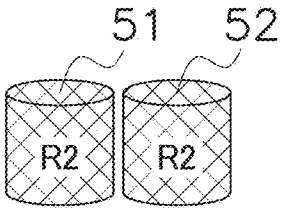

As illustrated in FIG. 27, the first refrigerant storage container 51 and the second refrigerant storage container 52 finish accommodating the second refrigerant R2.

(1-4) Fourth Step (Step S304)

Figure 28:
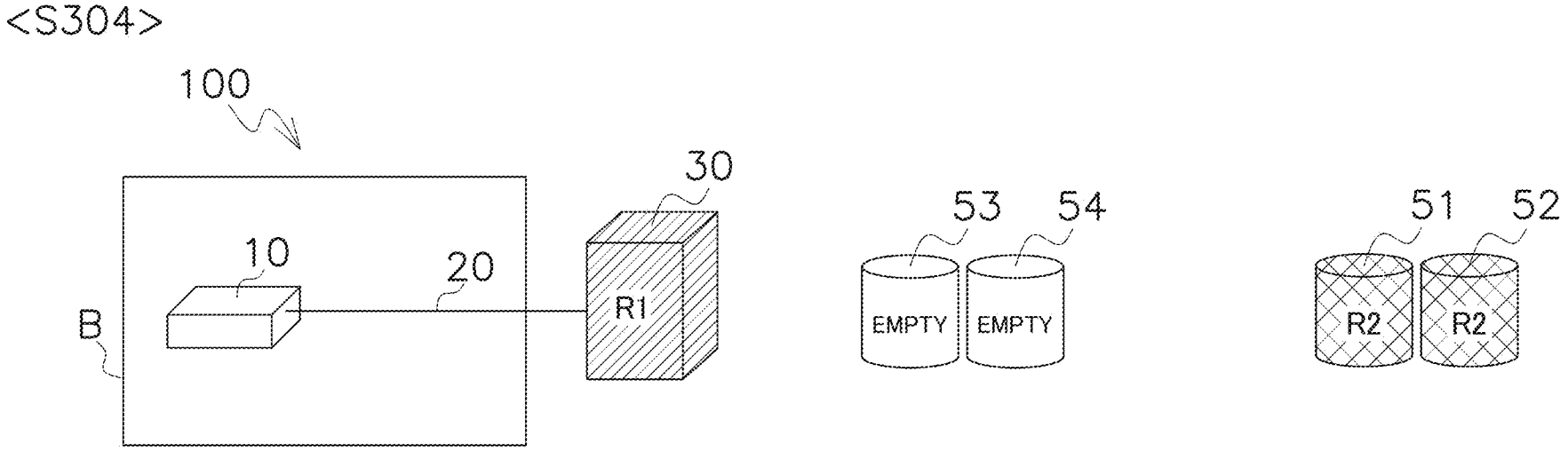
FIG. 28 illustrates a fourth step (step S304) of the installation method according to the third embodiment.

As illustrated in FIG. 28, the first refrigerant storage container 51 and the second refrigerant storage container 52 are transported to near the building B. The third refrigerant storage container 53 and the fourth refrigerant storage container 54 that are empty are prepared near the building B. In the present description, it is assumed that the number of the third refrigerant storage containers 53 and the number of the fourth refrigerant storage containers 54 are both one. Alternatively, the numbers may be two or more.

In the building B, the refrigerant cycle apparatus 100 is installed using a new first heat source unit 30. The refrigerant cycle apparatus 100 is filled with the first refrigerant R1.

(1-5) Fifth Step (Step S305)

Figure 29:
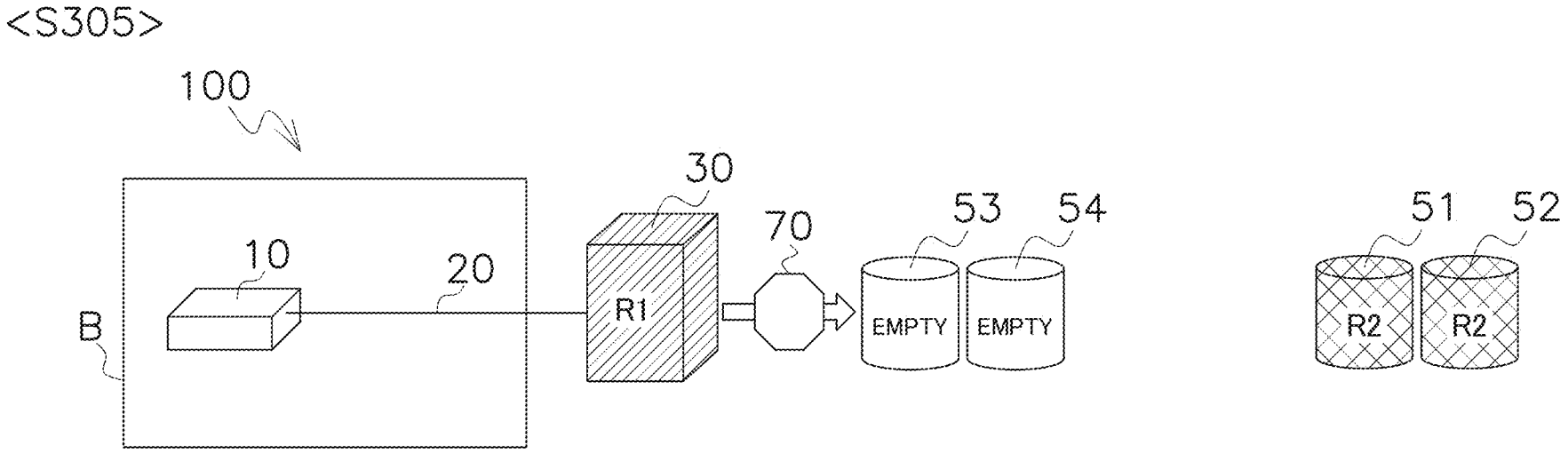
FIG. 29 illustrates a fifth step (step S305) of the installation method according to the third embodiment.

As illustrated in FIG. 29, the first refrigerant R1 is recovered from the first heat source unit 30 of the refrigerant cycle apparatus 100. During the recovery of the first refrigerant R1, the first lubricating oil L1 accommodated in the first heat source unit 30 may be left in the first heat source unit 30.

The recovered first refrigerant R1 is regenerated by a refrigerant regenerator 70. In this regeneration processing, the refrigerant regenerator 70 may remove water included in the first refrigerant R1 from the first refrigerant R1.

(1-6) Sixth Step (Step S306)

Figure 30:
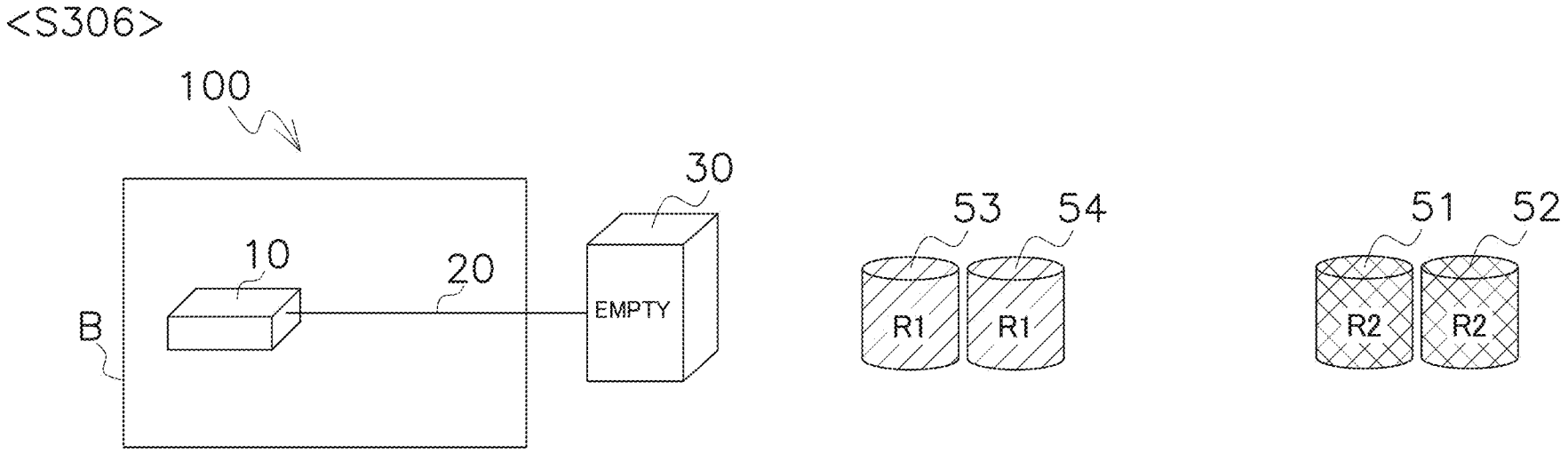
FIG. 30 illustrates a sixth step (step S306) of the installation method according to the third embodiment.

As illustrated in FIG. 30, the regenerated first refrigerant R1 is transferred from the refrigerant regenerator 70 to the third refrigerant storage container 53 and the fourth refrigerant storage container 54. In the first heat source unit 30, almost no first refrigerant R1 is present.

(1-7) Seventh Step (Step S307)

Figure 31:
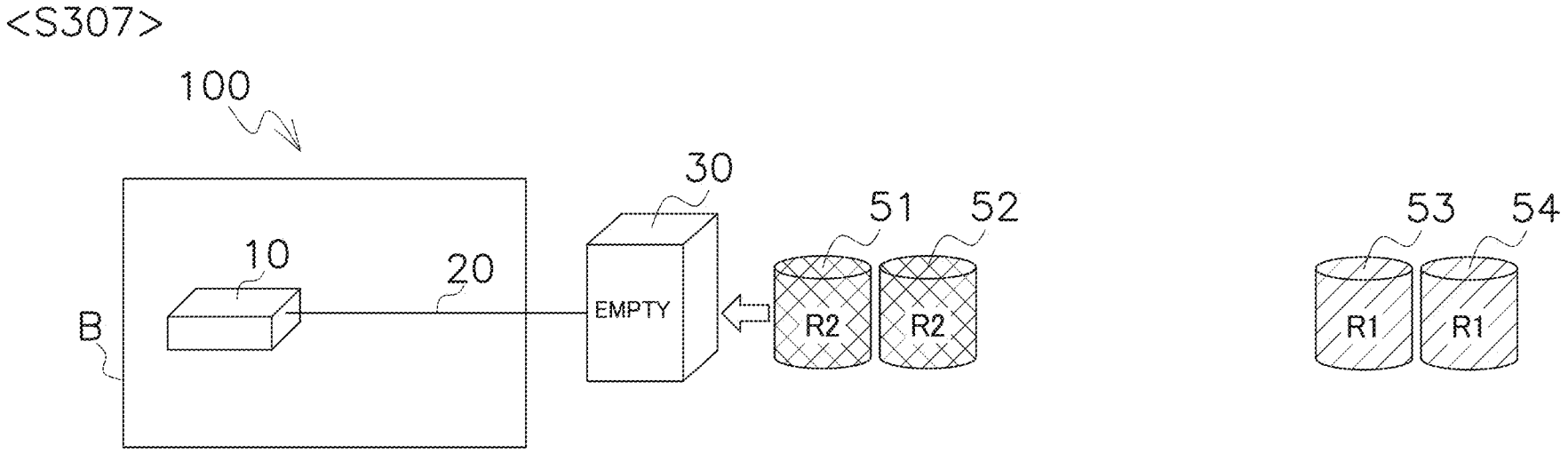
FIG. 31 illustrates a seventh step (step S307) of the installation method according to the third embodiment.

As illustrated in FIG. 31, the regenerated second refrigerant R2 accommodated in the first refrigerant storage container 51 and the second refrigerant storage container 52 is accommodated in the first heat source unit 30.

(1-8) Eighth Step (Step S308)

Figure 32:
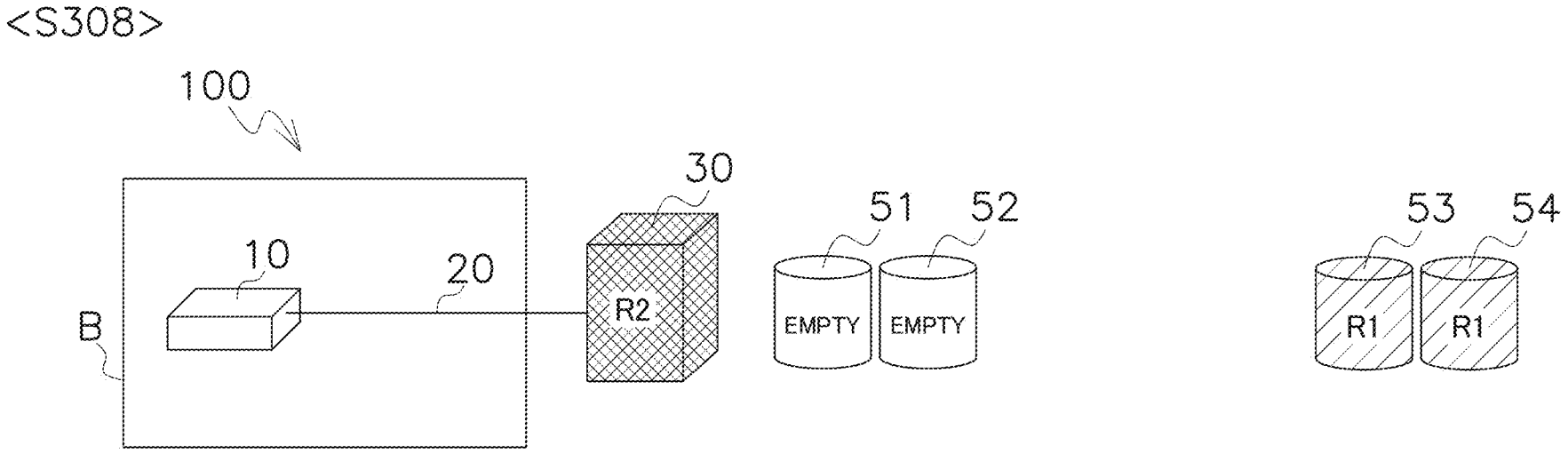
FIG. 32 illustrates an eighth step (step S308) of the installation method according to the third embodiment.

As illustrated in FIG. 32, the refrigerant cycle apparatus 100 receives the second refrigerant R2 in an amount required by the refrigerant cycle apparatus 100 as a whole. Accordingly, the refrigerant cycle apparatus 100 can be used.

(1-9) Ninth Step (Step S309)

Figure 33:
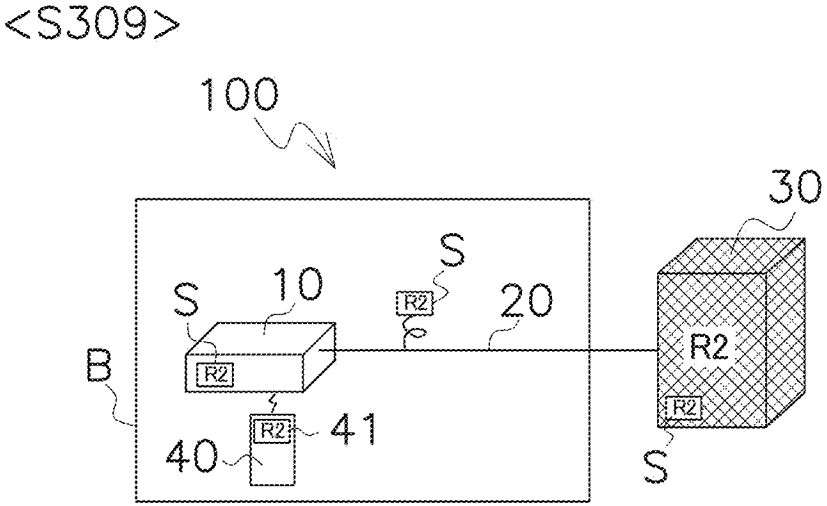
FIG. 33 illustrates a ninth step (step S309) of the installation method according to the third embodiment.

As illustrated in FIG. 33, the display S indicating that the second refrigerant R2 is used is attached to at least a part of the utilization unit 10, the connection piping 20, or the first heat source unit 30. The remote controller 40 may include a display unit 41 that electrically displays that the second refrigerant R2 is used. The content and form of the information displayed on the display unit 41 are similar to those in the first embodiment.

(2) Setting of Type of Refrigerant

The setting of the type of refrigerant in the third embodiment is similar to that in the first embodiment.

(3) Characteristics

In the installation method according to the present embodiment, the refrigerant cycle apparatus 100 that is new as a whole can be installed using the first heat source unit 30 of a new mode.

Conclusion

Although the embodiments of the present disclosure have been described above, it will be understood that various changes in form and details can be made without departing from the spirit and scope of the present disclosure described in claims.

The invention claimed is:

1. An installation method for a refrigerant cycle apparatus including a first heat source unit, a utilization unit, and a connection pipe, the installation method comprising:

a refrigerant recovery step of recovering a first refrigerant having a first GWP and one or both of flammability and toxicity from the first heat source unit;

a refrigerant accommodation step of accommodating, in the first heat source unit, a second refrigerant recovered and regenerated from an existing facility and having a second GWP and one or both of non-flammability and non-toxicity, the existing facility being an existing refrigerant cycle apparatus including a second heat source unit, the utilization unit, and the connection pipe;

a refrigerant recovery and regeneration step of recovering the second refrigerant from the existing facility and regenerating the second refrigerant;

a disconnection step of disconnecting the second heat source unit from the existing refrigerant cycle apparatus; and a connection step of connecting the first heat source unit to the connection pipe to configure the refrigerant cycle apparatus.

2. The installation method according to claim 1, wherein in the refrigerant recovery and regeneration step of the second refrigerant, the second refrigerant is accommodated at least in a refrigerant storage container.

3. The installation method according to claim 1, wherein in the refrigerant recovery and regeneration step of the second refrigerant, the second refrigerant is accommodated in at least the first heat source unit.

4. The installation method according to claim 1, wherein in the refrigerant recovery and regeneration step of the second refrigerant, one or both of second lubricating oil and water included in the second refrigerant is removed from the second refrigerant.

5. The installation method according to claim 1, wherein in the refrigerant recovery step of the first refrigerant, first lubricating oil accommodated in the first heat source unit is left in the first heat source unit.

6. The installation method according to claim 1, wherein the first heat source unit includes a gas refrigerant port and a liquid refrigerant port, and in the refrigerant recovery step of the first refrigerant, the first refrigerant is recovered from the first heat source unit through the gas refrigerant port.

7. The installation method according to claim 1, further comprising:

a refrigerant regeneration step of regenerating the first refrigerant recovered in the refrigerant recovery step of the first refrigerant.

8. The installation method according to claim 1, further comprising:

a refrigerant display step of attaching, to at least the first heat source unit, a display indicating that the second refrigerant is used.

9. The installation method according to claim 1, wherein the second refrigerant is a mixed refrigerant including a component identical to a component of the first refrigerant.

10. The installation method according to claim 1, wherein the second GWP is larger than the first GWP.

11. An installation method for a refrigerant cycle apparatus including a first heat source unit, a utilization unit, and a connection pipe, the installation method comprising:

a refrigerant recovery step of recovering a first refrigerant having a first GWP and one or both of flammability and toxicity from the first heat source unit;

a refrigerant accommodation step of accommodating, in the first heat source unit, a second refrigerant recovered and regenerated from an existing facility and having a second GWP and one or both of non-flammability and non-toxicity, the existing facility being a separate-system refrigerant cycle apparatus including a constituent part different from the utilization unit and the connection pipe; and a refrigerant recovery and regeneration step of recovering the second refrigerant from the existing facility and regenerating the second refrigerant, in the refrigerant recovery and regeneration step of the second refrigerant, the second refrigerant being accommodated in at least the first heat source unit.

12. The installation method according to claim 11, wherein in the refrigerant recovery and regeneration step of the second refrigerant, the second refrigerant is accommodated at least in a refrigerant storage container.

13. The installation method according to claim 11, wherein in the refrigerant recovery and regeneration step of the second refrigerant, one or both of second lubricating oil and water included in the second refrigerant is removed from the second refrigerant.

* * * * *